United States Patent [19]

Weinerman et al.

[11] Patent Number: 5,069,491

[45] **Date of Patent: * Dec. 3, 1991**

[54] VEHICLE DOOR LOCK SYSTEM

[75] Inventors: Lee S. Weinerman, Medina; Joel T. Vargus, Parma, both of Ohio

[73] Assignee: The Eastern Company, Cleveland, Ohio

[ * ] Notice: The portion of the term of this patent subsequent to Jan. 30, 2007 has been disclaimed.

[21] Appl. No.: 472,208

[22] Filed: Jan. 29, 1990

Related U.S. Application Data

[63] Continuation-in-part of Ser. No. 456,048, Dec. 26, 1989, abandoned, Ser. No. 109,479, Oct. 16, 1987, Pat. No. 4,896,906, Ser. No. 390,214, Aug. 7, 1989, Pat. No. D. 319,001, Ser. No. 390,669, Aug. 7, 1989, Pat. No. D. 311,323, and Ser. No. 390,671, Aug. 7, 1989, Pat. No. D. 311,324, said Ser. No. 390,214, Ser. No. 390,669, and Ser. No. 390,671, each is a continuation-in-part of Ser. No. 320,894, Mar. 9, 1989, abandoned, which is a continuation of Ser. No. 222,349, Jul. 20, 1988, abandoned, which is a continuation of Ser. No. 106,934, Oct. 5, 1987, abandoned, which is a continuation of Ser. No. 830,709, Feb. 18, 1986, abandoned, said Ser. No. 456,048, is a continuation of Ser. No. 320,894, , which is a continuation of Ser. No. 222,349, , which is a continuation of Ser. No. 106,934, , which is a continuation of Ser. No. 830,709, , said Ser. No. 109,479, is a continuation-in-part of Ser. No. 106,934, , and Ser. No. 54,687, May 27, 1987, abandoned, which is a continuation-in-part of Ser. No. 830,709.

[51] Int. Cl.[5] ..... E05C 3/26

[52] U.S. Cl. ..... 292/48; 292/341.12; 292/216

[58] Field of Search ..... 292/48, 216, DIG. 40, 292/341.12, 342, DIG. 14, DIG. 39, DIG. 51, 48, 337, 280, 336.3, 44, 45

[56] References Cited

U.S. PATENT DOCUMENTS 3,719,380 3/1973 Watermann ..... 292/216

*Primary Examiner*—Richard E. Moore

*Attorney, Agent, or Firm*—David A. Burge

[57] ABSTRACT

A vehicle door lock system includes a rotary latch having an elongate housing with an end formation that is "inclined" or "tapered" so as to be wedgingly engaged, when "latched," by a correspondingly inclined or tapered wedge block component of an L-shaped striker assembly. As the rotary latch releasably engages the striker to effect "latching," the inclined or tapered end region of the latch housing cooperatively engages the wedge block of the striker to guide the latch into properly aligned engagement with the striker, and to maintain proper alignment of the rotary latch with the striker while "latched." By this arrangement, a strong, racking-resistant type of latched connection is provided that will assist in preventing undesired relative movements of a door and a door frame on which the latch and striker are mounted, respectively. Handle assemblies are connected to the rotary latch to operate the latch to effect "unlatching" of the latch and the striker. "Locking" and "unlocking" of the latch is effected by selectively enabling and disabling driving connections between the handle assemblies and the rotary latch.

43 Claims, 15 Drawing Sheets

VEHICLE DOOR LOCK SYSTEM

CROSS-REFERENCE TO RELATED APPLICATIONS & PATENTS

The present application is a continuation-in-part of TWO UTILITY APPLICATIONS and THREE DESIGN APPLICATIONS, and is related to a number of other cases that are ancestors to said two utility and three design applications, with patents having issued on a number of these cases as is explained below:

1) The present application is a continuation-in-part of utility application Ser. No. 07/456,048 filed 12/26/89 (abandoned), which was a continuation of Ser. No. 07/320,894 filed 03/09/89 (abandoned), which was a continuation of Ser. No. 07/222,349 filed 07/20/88 (abandoned), which was a continuation of Ser. No. 07/106,934 filed 10/05/87 (abandoned), which was a continuation of Ser. No. 06/830,709 filed 02/18/86 (abandoned), all of which cases are included hereinafter in the term "Other Parent Cases," the disclosures of which are incorporated herein by reference;

2) The present application is a continuation-in-part of utility application Ser. No. 07/109,479 filed 10/16/87 and issued as U.S. Pat. No. 4,896,906, referred to hereinafter as the "Double-Wedge Patent Case"—it further being noted that said Ser. No. 07/109,479 was filed as a continuation-in-part of two applications, namely said Ser. No. 07/106,934, and Ser. No. 07/054,687 filed 05/27/87 (abandoned) filed as a continuation-in-part of said Ser. No. 06/830,709, the disclosures of which are incorporated herein by reference;

3) The present application is a continuation-in-part of design application Ser. No. 07/390,214 filed 08/07/89 and issued as U.S. Pat. No. Des. 319,001—it further being noted that said Ser. No. 07/390,214 was filed as a continuation-in-part of said Ser. No. 07/320,894 which was filed as a continuation of said Ser. No. 07/222,349 which was filed as a continuation of said Ser. No. 07/106,934 which was filed as a continuation of said Ser. No. 06/830,709, all of which cases are included hereinafter in the term "Other Parent Cases," the disclosures of which are incorporated herein by reference;

4) The present application is a continuation-in-part of design application Ser. No. 07/390,669 filed 08/07/89 and issued as U.S. Pat. No. Des. 311,323—it further being noted that said Ser. No. 07/390,669 was filed as a continuation-in-part of said Ser. No. 07/320,894 which was filed as a continuation of said Ser. No. 07/222,349 which was filed as a continuation of said Ser. No. 07/106,934 which was filed as a continuation of said Ser. No. 06/830,709, all of which cases are included hereinafter in the term "Other Parent Cases," the disclosures of which are incorporated herein by reference; and, 5) The present application is a continuation-in-part of design application Ser. No. 07/390,671 filed 08/07/89 and issued as U.S. Pat. No. Des. 311,324—it further being noted that said Ser. No. 07/390,671 was filed as a continuation-in-part of said Ser. No. 07/320,894 which was filed as a continuation of said Ser. No. 07/222,349 which was filed as a continuation of said Ser. No. 07/106,934 which was filed as a continuation of said Ser. No. 06/830,709, all of which cases are included hereinafter in the term "Other Parent Cases," the disclosures of which are incorporated herein by reference.

BACKGROUND OF THE INVENTION

1. Field of the Invention

The present invention relates generally to a door lock system for releasably latching and selectively locking a door, typically a door of a motor vehicle such as a passenger car, van, truck, motor coach, recreational vehicle or the like. More particularly, the present invention relates to a novel and improved, door lock system that includes a rotary latch having an elongate housing with an end formation that is "inclined" or "tapered" so as to be wedgingly engaged, when "latched," by a correspondingly inclined or tapered wedge block component of an L-shaped striker assembly. As the rotary latch releasably engages the striker to effect "latching," the inclined or tapered end region of the latch housing cooperatively engages the wedge block of the striker to guide the latch into properly aligned engagement with the striker, and to maintain proper alignment of the rotary latch with the striker while "latched."

2. Prior Art

In prior practice, it is customary to provide a side door of a vehicle such as an automobile, van, truck or the like with a door-carried lock system that is operable, when the door is closed adjacent a door frame that defines a passenger access opening, to "latch" the door as by bringing rotatable components of a rotary latch into surrounding and restraining, but selectively releasable engagement with a door-frame-carried striker.

It is customary, also, to provide a side door of a vehicle with interior and exterior handle assemblies which may be operated to "unlatch" the rotary latch and to thereby permit door movement out of its closed position.

Still further, it is customary to provide a key cylinder in association with the exterior handle assembly, with the key cylinder being operable selectively to "lock" and "unlock" components of the door lock mechanism as by selectively preventing and permitting the exterior door handle assembly from unlatching the door.

Typically, the door lock mechanism of a vehicle side door also can be "locked" and "unlocked" by vertically shifting what is referred to as a "sill button." The sill button usually takes the form of an elongate, interiorly accessible, vertically movable button that has a lower end region which is connected to a control rod that is housed within the structure of a door, and an upper end region that projects through a sill opening that is defined by the door structure at a location near the bottom level of a window opening that is defined by the door structure. Depressing the sill button to its lowermost or "locked" position causes the control rod to set components of the door lock mechanism to a "locked" configuration that will prevent at least the exterior handle assembly from unlatching the door. Raising the button to its uppermost or "unlocked" position causes the control rod to effect unlocking of components of the door lock system components so that operation of the exterior handle assembly will function to unlatch the door.

Moreover, it is known to provide a door lock system of a side door of a vehicle with apparatus for assuring that, when components of the door lock system are locked, the interior handle assembly (in addition to the exterior handle assembly) will be prevented from unlatching the door. This feature of fully disabling the interior handle when a sill button has been depressed (i.e., when the door lock system has been "locked") is particularly desirable for use with vehicles that transport children, the intended purpose being to prevent unwanted opening of a vehicle door as the result of a child's tampering with or operating the interior handle assembly. In the industry, such apparatus as may be provided to disable an interior door handle when a door lock system is "locked" often is referred to by the term "childproofing mechanism."

While vehicle door lock systems of a variety of configurations have been proposed, with many including so-called "childproofing mechanisms," prior proposals (i.e., proposals that predate the inventions that are addressed by the utility applications that are included among the Parent Cases that are identified above) typically suffer from one or more drawbacks. One problem has been a lack of versatility of system components that severely limits not only the type, style, shape and/or structural configuration of doors with which a particular locking system proposal can be used, but also limits the relative arrangements of interior and exterior handle assemblies, key cylinder and sill button hardware with which a particular locking system proposal can be used. Moreover, the systems of prior proposals typically require custom made operating handle assemblies and/or other custom components, it being recognized that custom components often are relatively expensive to manufacture.

To the degree that some of said prior proposals for door lock systems are adaptable for use with commercially available components such as operating handle assemblies, key cylinder and sill button hardware, the complexity of the resulting door lock systems, and attendant difficulties of assembly and adjustment for proper operation that are encountered in installing the resulting systems often have proven to be undesirable and, in some cases, economically infeasible.

Accordingly, despite the existence of a plurality of said proposals for door lock systems, a need has remained for an improved, highly versatile door lock system including a well proven basic type of rotary latch, and an associated connection linkage assembly, with these components being so arranged and interconnected that they are capable of working in harmony with a wide range of commercially available interior and exterior operating handle assemblies, as well as with commercially available key cylinder and sill button hardware.

3. The Referenced "Parent Cases"

The inventions of the several Parent Cases address the foregoing and other drawbacks of the prior art by providing a novel and improved vehicle door lock systems that each includes a rotary latch and a connection linkage assembly that is sufficiently versatile to permit its use with a wide variety of commercially available interior and exterior operating handle assemblies, as well as with commercially available key cylinder and sill button control hardware, with the connecting linkage including a capability for providing desired safety features, for example, a "childproof" feature that permits an interior operating handle to be selectively enabled and disabled for unlatching the rotary latch so that children cannot open a "locked" door by tampering with or operating the interior handle.

A feature of the preferred practice of each of the invention of the referenced utility Parent Cases resides in its utilization of a well proven basic type of rotary latch—a rotary latch that has proven its acceptability in commercial use. Another feature lies in use that is made of commercially available forms of door lock system hardware including interior and exterior operating handle assemblies, as well as key cylinder and sill button components. Stated in another way, the preferred practice of each of the inventions of the referenced utility Parent Cases has the very significant advantage of not proposing a door lock system that is novel and unique throughout the range of elements that make up the system—rather, the invention, in its preferred practice, draws without reservation on strengths of proven designs and commercially available components which, with minimal cost, provide a highly reliable door lock system.

Another feature of the preferred practice of each of the inventions of the referenced utility Parent Cases resides in providing as a "hub" or "centerpiece" of a door lock system, a novel rotary latch and connection linkage assembly of extremely versatile character that gives the system its capability to draw upon strengths, desired characteristics, and unique features of a host of commercially available door lock operating and control hardware such as commercially available interior and exterior operating handles to effect latching and locking of a vehicle door or other closure.

4. The Referenced "Plural Point Locking System Cases"

In one aspect, the invention of the Plural Point Door Locking System Cases that is referenced above (namely the invention that forms the subject matter of application Ser. No. 303,972 filed Jan. 30, 1989 from which a patent is expected to issue shortly) provides a simple and inexpensive means for converting a single point rotary latch type door lock system to a plural point rotary latch type door lock system. The system can be utilized to convert a single point rotary latch system to a plural point rotary latch system regardless of whether the single latch system includes a "childproofing" mechanism; and, if the single latch system includes a childproofing feature, the childproof operational characteristics of the single latch system are "extended" so as to be applicable to the rotary latches of the resulting plural latch system.

In the most preferred practice of the invention of the Plural Point Locking System Cases, a vehicle door lock system includes interior and exterior handle assemblies that are accessible, respectively, from interior and exterior sides of a vehicle door on which the door lock system is mounted. The system includes a plurality of rotary latches that are configured to releasably engage a plurality of door-frame-mounted strikers to "latch" and "unlatch" the door, and a latch interconnection linkage for effecting concurrent unlatching of the rotary latches. The door is "locked" and "unlocked" by selectively enabling and disabling driving connections between at least one of the handle assemblies and separate release arms that are arranged to operate a selected one of the rotary latches.

In the most preferred practice of the invention of the Plural Point Locking System Cases, locking and unlocking of the vehicle door are effected either by operating an exterior key cylinder, or by operating an interior sill button. The handle assemblies, the key cylinder and the sill button preferably are commercially available units that are arranged as may be appropriate for use with a particular vehicle door, with these units being interconnected for operation by a novel and highly versatile linkage, with elements of the linkage being operable to interact so that, 1) when the door is "latched" but not "locked," either of the handle assemblies may be operated to unlatch the door, 2) when the door is both "latched" and "locked," at least one of the handle assemblies is disabled from being operated to unlatch the door, and, 3) such locking and unlocking movements as are executed by the key cylinder will cause corresponding movements of the sill button between its locked and unlocked positions. 5. The Referenced "Double-Wedge Parent Case"

The invention of the Double-Wedge Parent Case that is referenced above (namely Ser. No. 109,479 filed Oct. 16, 1987 and issued Jan. 30, 1990 as U.S. Pat. No. 4,596,906 entitled VEHICLE DOOR LOCK SYSTEM) provides interactive latch housing and striker assembly components that effect a wedge-like interengagement to properly align the latch housing and the striker assembly during "latching," and that engage and cooperate, while "latched," to releasably maintain proper alignment whereby undesired relative movement of the latch housing and the striker assembly (and undesired relative movement of such door and door frame structures as mount the latch and striker) is prevented.

In preferred practice, a door lock system is provided that includes a rotary latch having an elongate housing with a pair of opposed end regions that are inclined or tapered so as to be securely received, when "latched," within an elongate U-shaped striker assembly that has a pair of spaced, inwardly facing wedge blocks at its opposed end regions. As the rotary latch releasably engages the striker to effect "latching," the tapered end regions of the latch housing are wedgingly engaged by the wedge blocks of the striker to guide the latch into properly aligned engagement with the striker, and to maintain proper alignment of the rotary latch with the striker while "latched." By this arrangement, a strong, racking-resistant type of latched connection is provided that will assist in preventing undesired relative movements of a door and a door frame on which the latch and striker are mounted, respectively. In preferred practice, handle assemblies are connected to the rotary latch to operate the latch to effect "unlatching" of the latch and the striker. "Locking" and "unlocking" of the latch is effected by selectively enabling and disabling driving connections between the handle assemblies and the rotary latch.

6. The Referenced "Companion Design Parent Cases"

The referenced Companion Design Parent Cases deal with the attractive, ornamental appearance of latch housing and striker assembly components of a type that preferably are employed in carrying out the best mode known to the inventors for practicing the present invention. Accordingly, in the drawings and in the detailed description that form a part of the present application, components that employ features which are illustrated in the referenced Companion Design Parent Cases are shown and described. It will be understood, however, that the invention of the present application can be practiced without utilizing the attractive appearance features that form the subjects of the referenced Companion Design Parent Cases.

SUMMARY OF THE INVENTION

The present invention provides a door locking system that has interactive latch housing and striker assembly components that effect a wedge-like interengagement to properly align the latch housing and the striker assembly during "latching," and that engage and cooperate, while "latched," to releasably maintain proper alignment whereby undesired relative movement of the latch housing and the striker assembly (and undesired relative movement of such door and door frame structures as mount the latch and striker) is prevented.

In large measure, the present invention represents an adaptation and restructuring of selected features of the invention of the referenced Double-Wedge Case. Whereas the invention of the Double-Wedge Case provides a latch housing that is received in a "double-wedging" type of interactive engagement with a striker, the system of the present invention provides a latch housing that is received in what can be characterized as a "single-wedging" type of interactive engagement with a striker, with the latch housing and the striker that embody the present invention preferably being of simpler configuration than are corresponding components that embody the invention of the Double-Wedge Parent Case.

In preferred practice, a door lock system is provided that includes a rotary latch having an elongate housing with an end formation that is "inclined" or "tapered" so as to be wedgingly engaged, when "latched," by a correspondingly inclined or tapered wedge block component of an L-shaped striker assembly. As the rotary latch releasably engages the striker to effect "latching," the inclined or tapered end region of the latch housing cooperatively engages the wedge block of the striker to guide the latch into properly aligned engagement with the striker, and to maintain proper alignment of the rotary latch with the striker while "latched." By this arrangement, a strong, racking-resistant type of latched connection is provided that will assist in preventing undesired relative movements of a door and a door frame on which the latch and striker are mounted, respectively. Handle assemblies preferably are connected to the rotary latch to operate the latch to effect "unlatching" of the latch and the striker. "Locking" and "unlocking" of the latch is effected by selectively enabling and disabling driving connections between the handle assemblies and the rotary latch.

A feature of the most preferred practice of the present invention resides in the provision of a novel and improved door locking system that includes a rotary latch and connection linkage assembly of the type disclosed in the referenced utility cases, i.e., a linkage that is sufficiently versatile to permit its use with a wide variety of commercially available interior and exterior operating handle assemblies, as well as with commercially available key cylinder and sill button control hardware, with the connecting linkage including a capability for providing desired safety features, for example, a "childproof" feature that permits an interior operating handle to be selectively enabled and disabled for unlatching the rotary latch so that children cannot open a "locked" door by tampering with or operating the interior handle.

A significant feature of the preferred practice of the present invention resides in its utilization of a well proven basic type of rotary latch—a rotary latch that has been the subject of a long-standing program of continued development, testing and design improvement, with the basic type of rotary latch unit utilized in preferred practice being one that has proven its acceptability in commercial use. Another feature lies in use that is made in the preferred practice of the present invention of commercially available forms of door lock system hardware including interior and exterior operating handle assemblies, as well as key cylinder and still button components. Stated in another way, the preferred practice of the present invention has the very significant advantage of not proposing a door lock system that is novel and unique throughout the range of elements that make up the system—rather, the invention, in its preferred practice, draws without reservation on strengths of proven designs and commercially available components which, with minimal cost, provide a highly reliable door lock system.

Another feature of the preferred practice of the present invention resides in providing as a "hub" or "centerpiece" of a door lock system, a novel rotary latch and connection linkage assembly of extremely versatile character that gives the system its capability to draw upon strengths, desired characteristics, and unique features of a host of commercially available door lock operating and control hardware such as commercially available interior and exterior operating handle assemblies, key cylinder and sill button hardware. As will be readily apparent to those skilled in the art, while the detailed description and the drawings that form parts of this document describe and illustrate a preferred embodiment of the invention, the novel rotary latch and connection linkage assembly is well adapted for use with a host of other configurations and arrangements of door lock system hardware, and with door constructions of many types and sizes, whereby the invention has far wider applicability than is specifically described in discussing the preferred embodiment. Unlike many prior proposals, a vehicle door lock system that embodies the preferred practice of the present invention utilizes a rotary latch and connection linkage assembly that is easily adapted for use not only with a wide variety of vehicle door sizes, shapes and structural configurations, but also with a wide variety of relative arrangements of operating and control hardware, whereby commercially available hardware components can be positioned and oriented in almost any desired relative arrangement with respect to a selected position for the rotary latch and connection linkage assembly.

In most preferred practice, a vehicle door lock system of the present invention includes interior and exterior handle assemblies that are accessible, respectively, from interior and exterior sides of a vehicle door on which the door lock system is mounted. The door lock system includes a rotary latch that is configured to releasably engage a door-frame-mounted striker to "latch" and "unlatch" the door. The door is "locked" and "unlocked" by selectively enabling and disabling driving connections between the handle assemblies and separate release arms of the rotary latch. More specifically, locking and unlocking of the door are effected either by operating an exterior key cylinder, or by operating an interior sill button. The handle assemblies, the key cylinder and the sill button preferably are commercially available units that are arranged as may be appropriate for use with a particular vehicle door, with these units being interconnected for operation by a novel and highly versatile linkage, with elements of the linkage being operable to interact so that, 1) when the door is "latched" but not "locked," either of the handle assemblies may be operated to unlatch the door, 2) when the door is both "latched" and "locked," neither of the handle assemblies may be operated to unlatch the door, and, 3) such locking and unlocking movements as are executed by the key cylinder will cause corresponding movements of the sill button between its locked and unlocked positions, whereby the positioning of the sill button serves to provide an indication of the "locked" and "unlocked" status of the door lock system.

Preferably, the connection linkage includes a plurality of interior and exterior operating rods. Selected ones of the interior and exterior operating rods are connected, respectively, to the interior and exterior handle assemblies, and/or to separate interior and exterior release levers that form parts of the rotary latch. The operating rods preferably are biased toward "normal" positions that are associated with "normal," seated or nested positions of movable handles that form elements of the associated interior and exterior handle assemblies. The interior and exterior operating rods are movable with their associated handles to separately operate the interior and exterior release levers of the rotary latch to effect unlatching of the rotary latch.

Preferably, the connection linkage also includes a plurality of interior and exterior control rods. Selected ones of the interior and exterior control rods are connected, respectively, to the interior sill button and to the exterior key cylinder, for movement by the sill button and by the key cylinder, respectively, to operate locking components of the door lock system that selectively permit and prohibit unlatching movement of the release levers of the rotary latch in response to operation of the interior and exterior handles.

In the most preferred practice of the present invention, a feature of the connection linkage is that, at one location, namely that of the connection linkage unit (which forms a sub-assembly of the rotary latch and connection linkage assembly), a plurality of pivotally mounted levers which extend in overlying relationship are interconnected in a novel and compact manner. The pivoted array of interconnected levers serves, in turn, to interconnect a plurality of operating and control rods.

Indeed, in the preferred embodiment of the invention that is described and depicted herein, a compact pivoted lever array serves to interconnect not only an opposed pair of operating rods, but also an opposed pair of control rods. The opposed control rods are, in fact, what have been referred to previously as the "interior and exterior control rods," which is to say that one of these control rods connects with the interior sill button, and the other with the exterior lock cylinder. The opposed operating rods are, in fact, segments of what has been referred to previously as the "interior operating rod," which is to say that the operating rod which connects the interior operating handle assembly with the interior release arm of the rotary latch is formed from segments that are selectively drivingly connected by the pivoted lever array.

By virtue of the presence and function of the pivoted lever array, the opposed control rods (i.e., the interior and exterior control rods) are operable, in response to locking and unlocking movements of the sill button and/or the key cylinder, to selectively enable and disable a driving connection between the opposed segments of the interior operating rod, whereby the opposed interior and exterior control rods cooperate with the pivoted lever array to enable and disable the interior operating handle assembly when the door is "unlocked" and "locked," respectively. But in significant addition to this "childproofing" function, the pivoted lever array causes the opposed control rods to cooperate with elements of the exterior operating handle assembly to assure that unlocking and locking movements of the external key cylinder are always reflected by corresponding raised or lowered positionings of the sill button, whereas locking and unlocking movements of the sill button are caused to disable and enable both of the interior and exterior operating handle assemblies.

Thus, in preferred practice, the connection linkage unit performs far more than the function of what has come to be referred to as a "childproofing mechanism." Indeed, the connection linkage unit serves, within a very compact and centrally located area that is adjacent to the rotary latch unit, to provide a multiplicity of functions, with as many as two pairs of operating and control rods connecting with the pivoted lever array, and with the pivoted lever array cooperating with other components of the door lock system to perform many of the interrelated functions of the door lock system that traditionally have required much more complex, space consuming, noncentralized assemblies to execute.

Moreover, because a compact pivoted lever array is employed at a location that is adjacent to the rotary latch unit to perform so many of the key functions of the door lock system, the versatility of the combined rotary latch and connection linkage assembly is enhanced, for operating and control rods can be arranged to extend in substantially any needed direction relative to the pivoted lever array to suitably connect the pivotal lever array with any of a wide variety of door lock operating and control hardware, and with such hardware being arranged and oriented as may be most preferred to accommodate a vehicle door of almost any desired size, shape and structural configuration.

BRIEF DESCRIPTION OF THE DRAWINGS

The foregoing and other advantages, and a fuller understanding of the invention that is described and claimed in the present application may be had by referring to the following description and claims taken in conjunction with the accompanying drawings wherein

FIG. 1 is a side elevational view of one preferred embodiment of a vehicle door lock system as viewed from an interior of a side door of a vehicle on which the system is mounted, with the door and portions of door-frame-carried strikers being shown in phantom, with portions of the door and the door lock system being foreshortened, and with components of the door lock system being depicted in their "latched" and "locked" configuration;

FIG. 2 is a side elevational view similar to FIG. 1, but with both an interior handle assembly and an exterior handle assembly of the door lock system being actuated while the system is "locked," whereby the interior handle assembly is operative to "unlatch" the door, but the operation of the "locked" exterior handle assembly serves no unlatching function;

FIG. 3 is a side elevational view similar to FIG. 1, but with components of the door lock system in their "latched" and "unlocked" configuration;

FIG. 4 is a side elevational view similar to FIG. 3, but with an exterior handle assembly of the door lock system being operated while the system is "unlocked," whereby the rotary latches of the door lock system are "unlatched" to release their strikers, and with this view also illustrating that operation of the exterior handle assembly does not cause corresponding operation of the interior handle assembly;

FIG. 5 is a side elevational view similar to FIG. 3, but with the interior handle assembly being operated while the system is "unlocked," whereby the rotary latches are "unlatched" to release their associated strikers, and with this view also illustrating that operation of the interior handle assembly does not cause corresponding operation of the exterior handle assembly;

FIG. 6 is a side elevational view from an exterior side of the door, with components of the door lock system oriented as depicted in FIG. 1 so that the door is both "latched" and "locked;"

FIG. 7 is an exploded perspective view of selected components of the exterior operating handle assembly as well as connected linkage assembly element, with some of the linkage elements being foreshortened;

FIG. 8 is an exploded perspective view, on an enlarged scale, of selected components of two rotary latch assemblies as well as connected linkage assembly elements, with some of the linkage elements being foreshortened;

FIG. 9 is an exploded perspective view of selected linkage assembly components;

FIG. 10 is a perspective view of selected elements of the linkage assembly;

FIG. 11 is a somewhat schematic end elevational view, as viewed substantially from a plane indicated by a line 10—10 in FIG. 1, depicting components of the rotary latches in their "latched" configuration surrounding and restraining associated strikers;

FIG. 12 is a view similar to FIG. 11 but depicting components of the rotary latches in configurations that are intermediate their "latched" and "unlatched" positions, but, nonetheless, engaging and restraining their associated strikers;

FIG. 13 is a view similar to FIGS. 11 and 12, but depicting components of the rotary latches unit in their "unlatched" configuration, with the strikers being released as during opening or closing of the door;

FIG. 14 is a side elevational view similar to FIG. 1, but illustrating an alternate embodiment that incorporates "childproof" features that are described in and form the subject matter of certain of the referenced Parent Cases;

FIG. 15 is a perspective view, on an enlarged scale, showing a rotary latch and striker that employ a latch housing and a mating striker assembly that interengage in a wedge-like action in accordance with features of the invention of the referenced Double-Wedge Parent Case, with the view showing principally one side of each of the latch and the striker, and with the view showing the latch and striker in mating engagement;

FIG. 16 is a perspective view similar to FIG. 15 but with the latch and striker separated, and with the latch "unlatched;"

FIG. 17 is a perspective view similar to FIG. 15 but showing principally opposite sides of the latch and striker;

FIG. 18 is a top plan view, on a slightly reduced scale, of the components of FIG. 17; and, Wherein the following Figures depict improvement features of the present invention that, in preferred practice, are utilized with the door lock systems of type that are depicted in FIGS. 1–14, wherein:

DESCRIPTION OF THE PREFERRED EMBODIMENT

Figure 1:
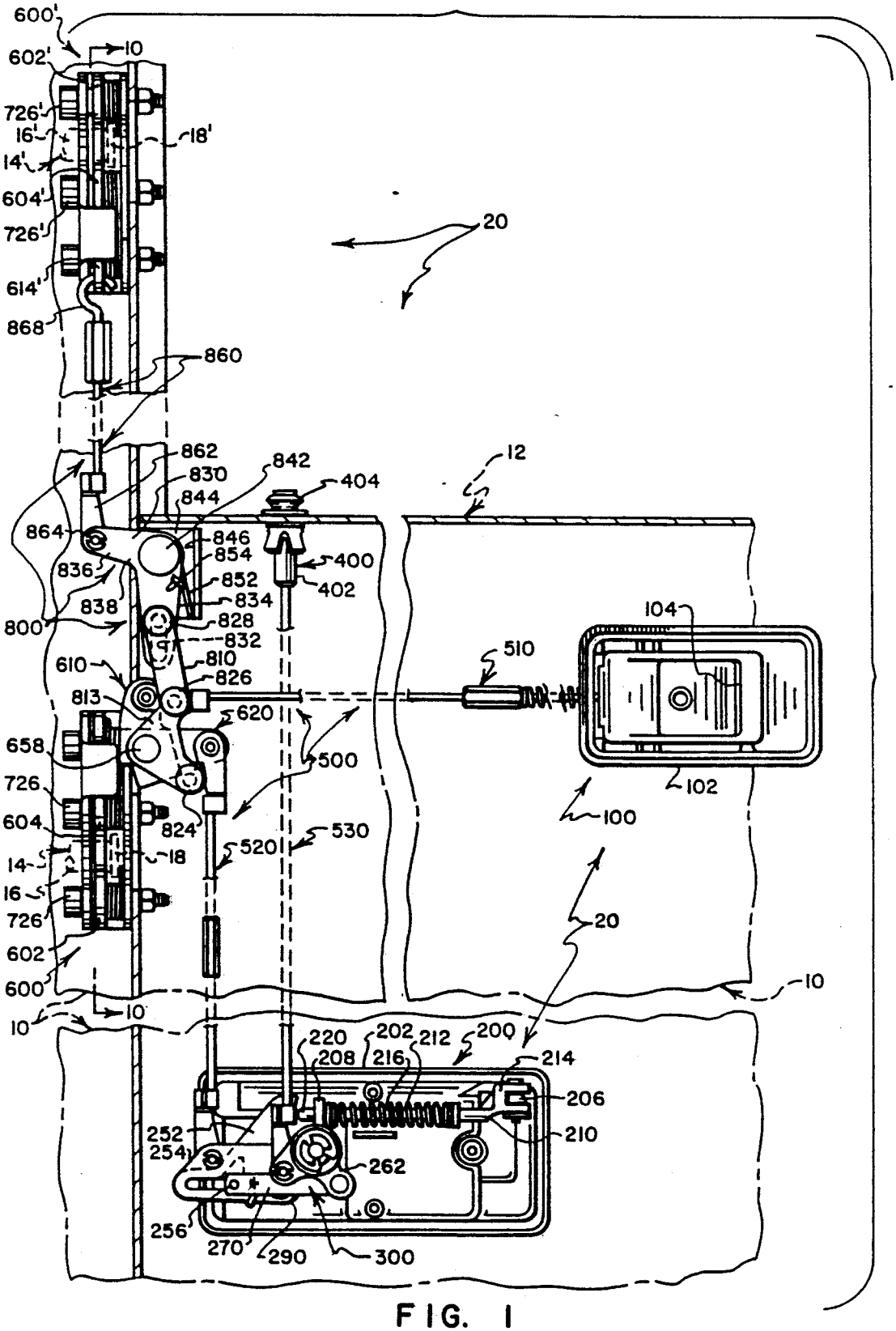
FIGS. 1–18 are reproduced from the referenced Double-Wedge Parent Case and are described as follows.

By way of background, and in order to properly describe in appropriate detail a typical environment in which the best mode known to the inventors for carrying out invention is practiced, FIGS. 1–18 have been reproduced from the referenced Double-Wedge Parent Case; likewise, relevant portions of the description of FIGS. 1–18 have been extracted from the Double-Wedge Parent Case and reproduced herein. FIGS. 19–22 depict such improvements as are added in accordance with the preferred practice of the present invention.

Referring to FIGS. 1–6, portions of a side door of a vehicle are indicated generally by the numeral 10 and are shown in phantom. The door 10 has a window sill that is designated by the numeral 12. Also shown in phantom in FIGS. 1–5 are portions of two elongate, cantilevered striker pins 14, 14′ that are mounted on door frame portions (not shown) of the vehicle and that extend adjacent to the door 10 when the door 10 is closed. The striker pins 14, 14′ have generally cylindrical central portions 16, 16′ that are shown in cross section in FIGS. 11–13. The striker pins 14, 14′ have hex head formations 18, 18′ at their distal ends, as is shown in FIG. 13.

Figure 14:
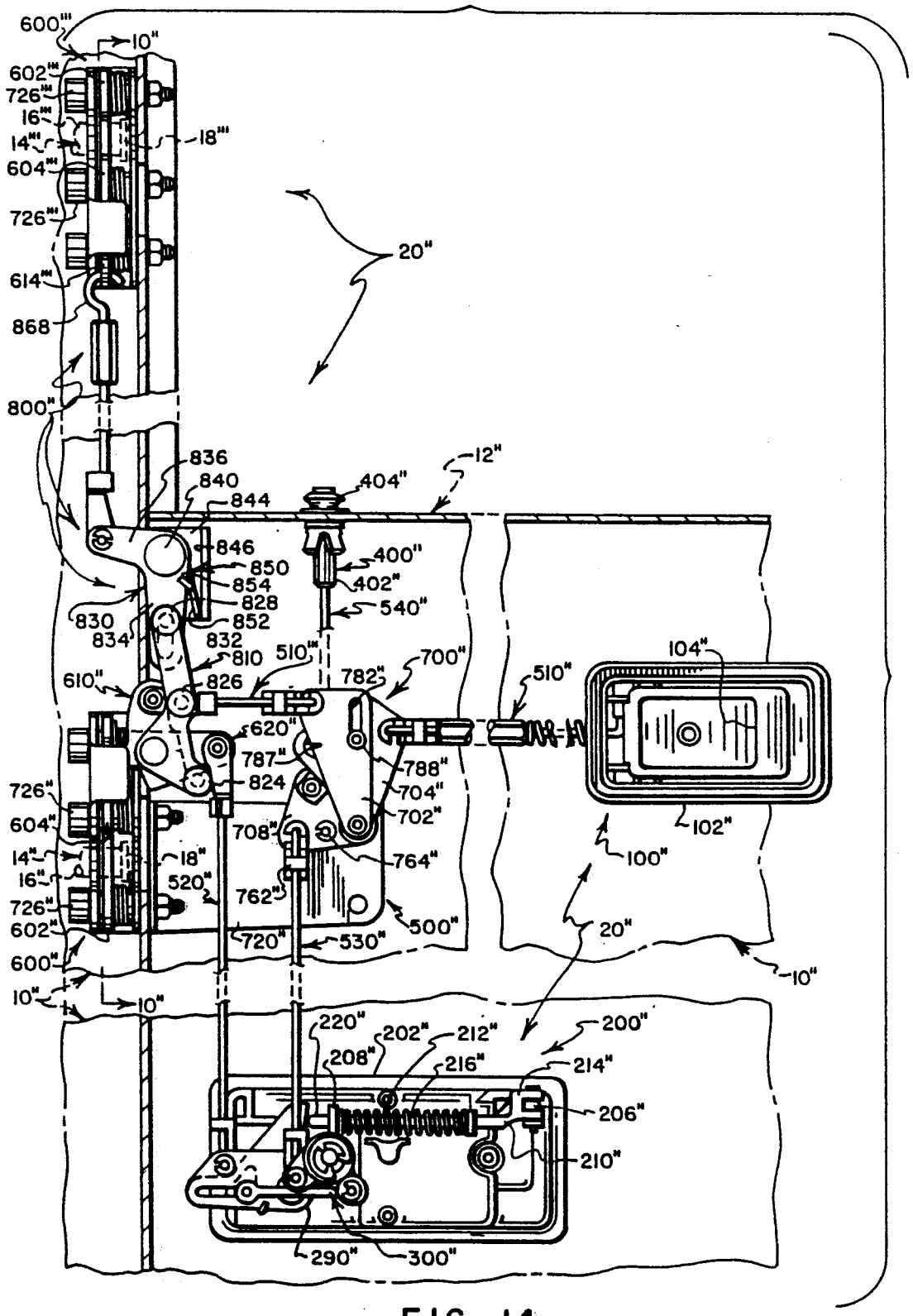

A vehicle door lock system that embodies one form of preferred practice of the invention of the referenced Plural Point Locking System Cases is indicated generally by the numeral 20. While the system 20 includes no "childproofing" feature to disable an internal door handle when the system 20 is "locked," an application of features of the present invention to a door lock system 20″ that includes a "childproof" feature is depicted in FIG. 14, as will be explained in greater detail.

Figure 2:
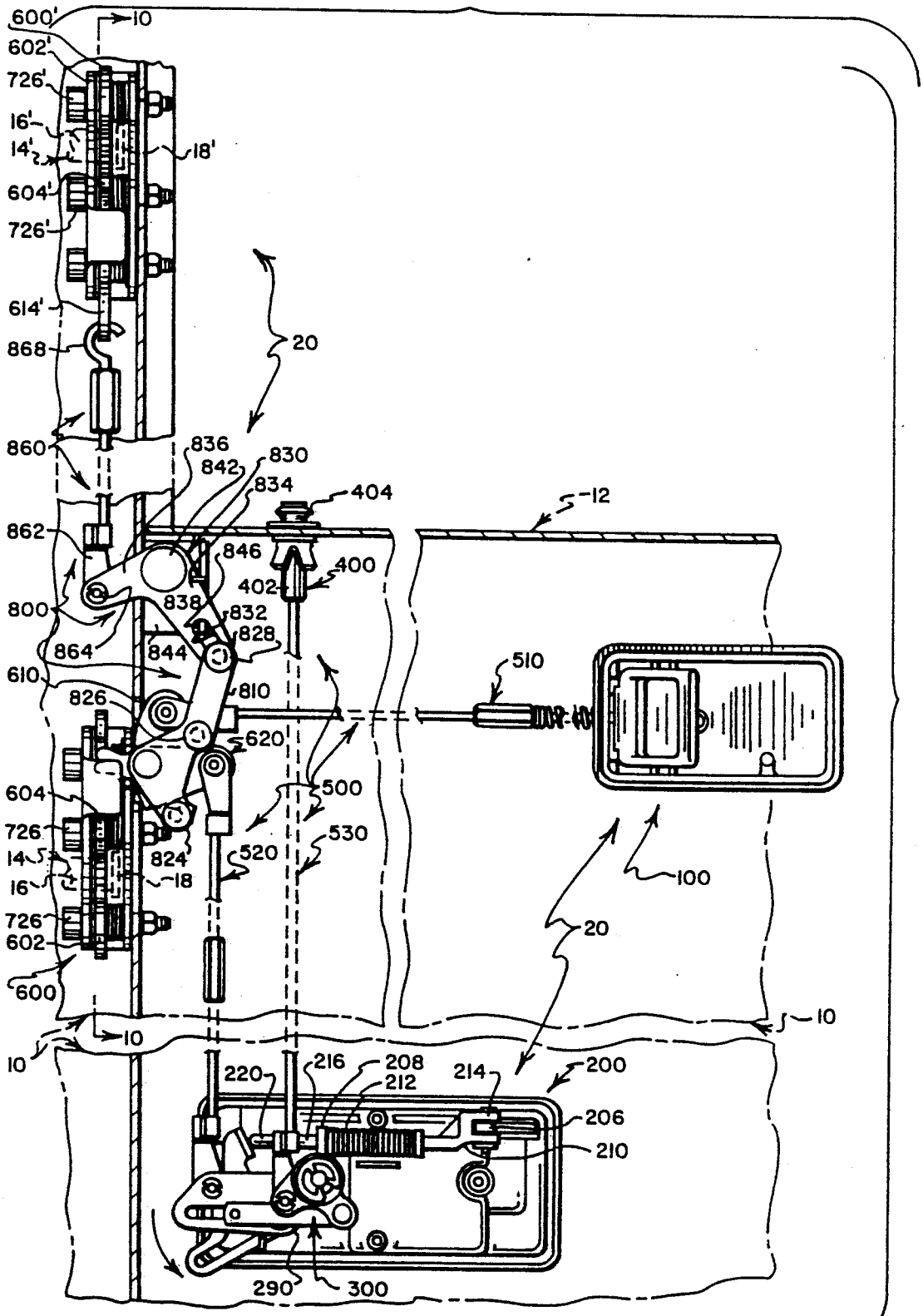
Figure 3:
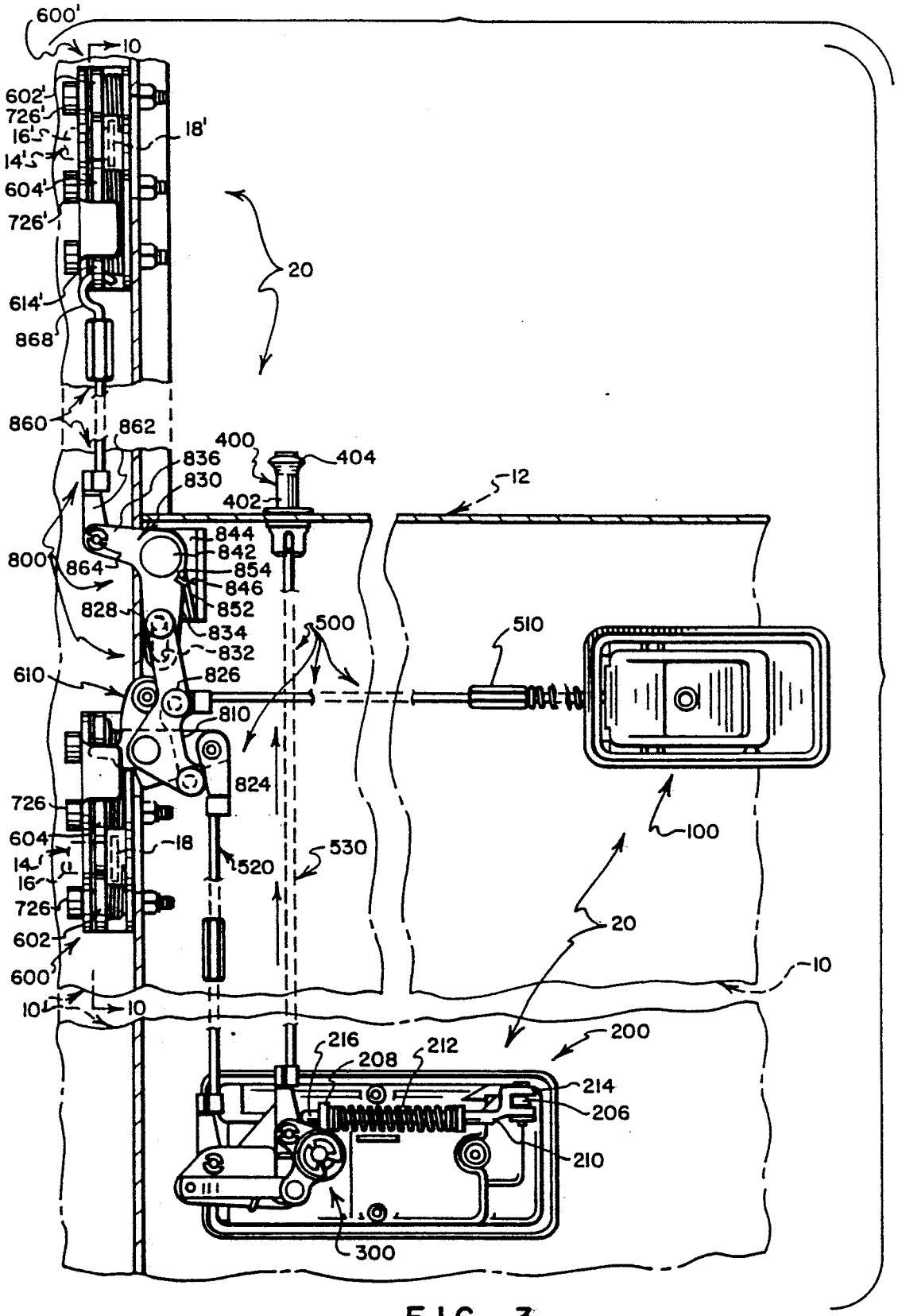
Figure 4:
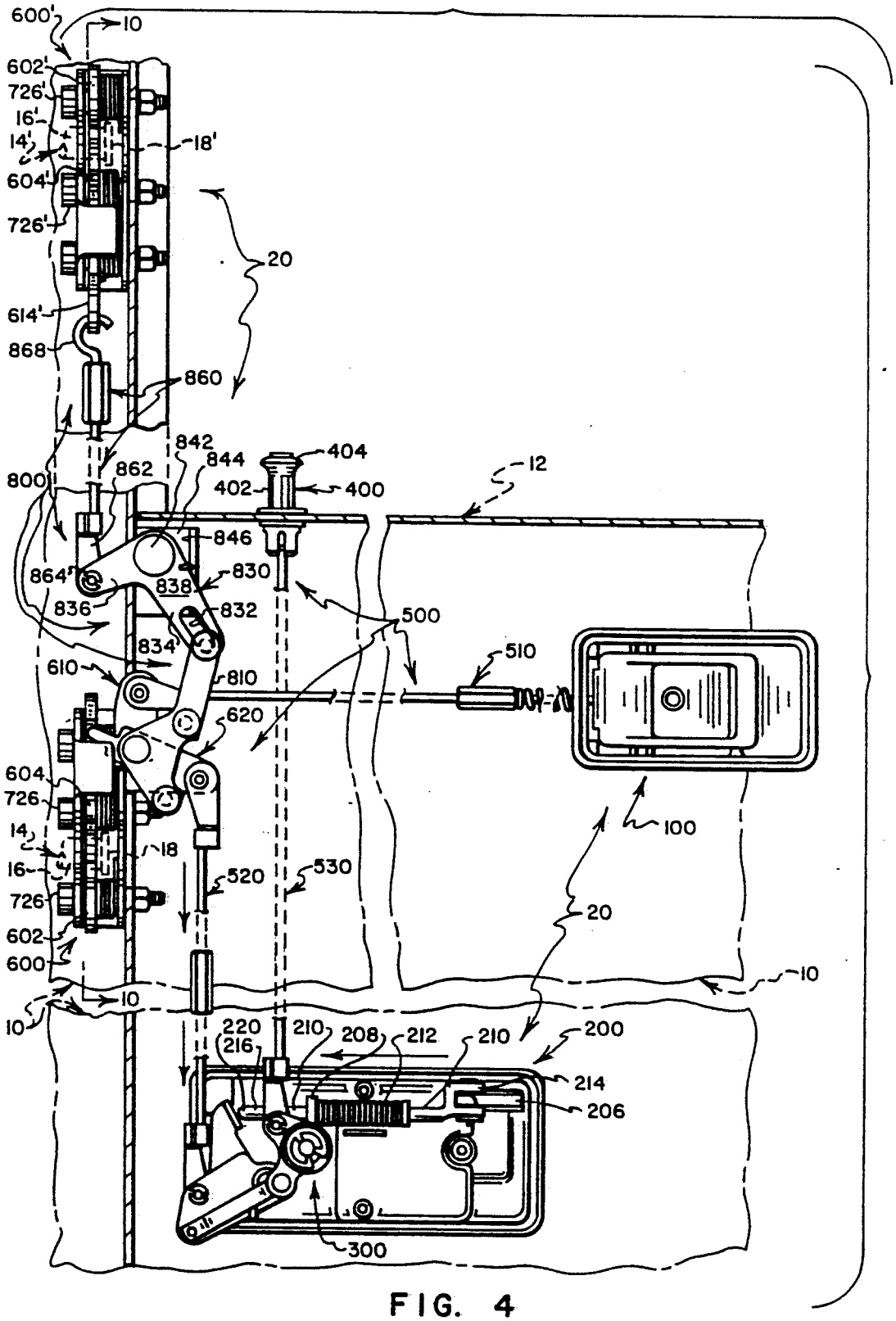
Figure 5:
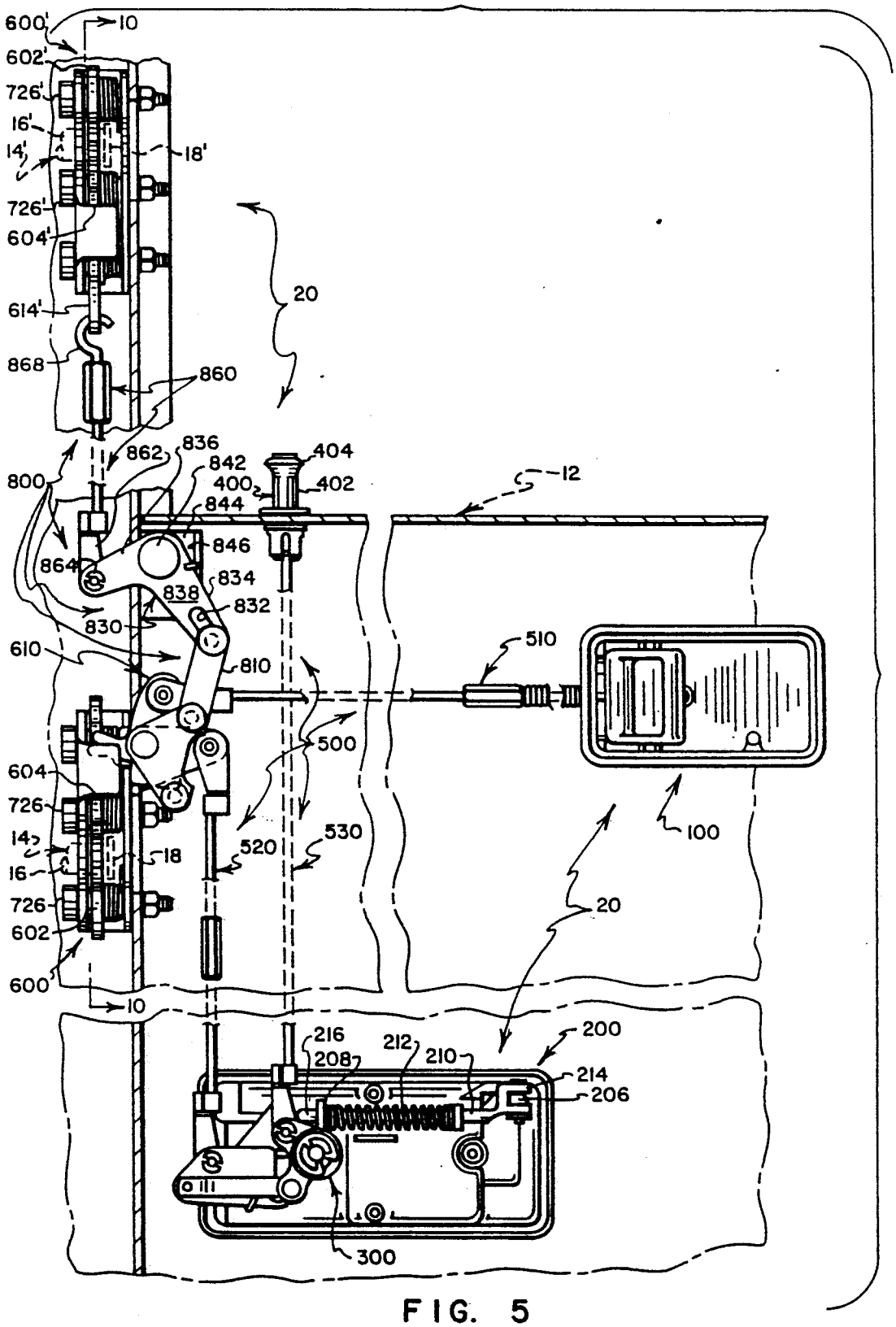
Figure 6:
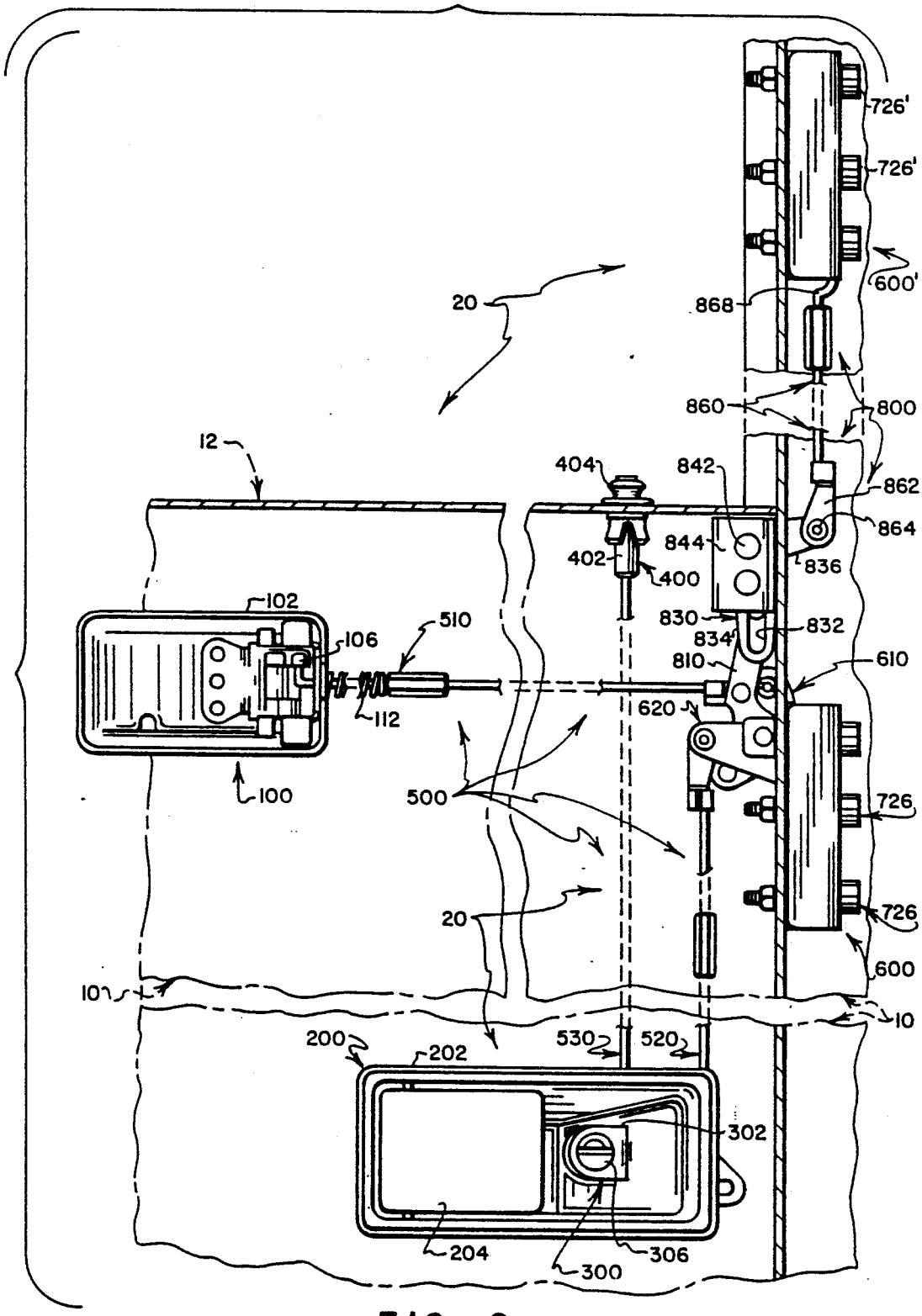

In brief overview, FIGS. 1–5 depict components of the door lock system 20 as viewed from an interior side of the door 10. FIG. 6 depicts components of the door lock system 20 as viewed from an exterior side of the door 10. In FIGS. 1 and 6, the door 10 is "locked," with rotary latches 600, 600′ of the door lock system 20 in "latched" engagement with the strikers 14, 14′. In FIG. 3 the door 10 is "unlocked" but "latched." FIGS. 2, 4 and 5 show the door 10 "unlocked" and "unlatched."

The door lock system 20 incorporates several commercially available components including an interior operating handle assembly 100, an exterior operating handle assembly 200, an exterior key cylinder assembly 300 (that typically is sold as a part of the exterior handle assembly 200), and an interior sill button 400. The door lock system 20 also includes a pair of commercially available rotary latches 600, 600′ together with a latch-and-handle connection linkage 500 and a novel latch unit interconnection linkage assembly which is indicated generally by the numeral 800. The linkage assembly 500 interconnects the components 100, 200, 300, 400 and 600, while the latch unit interconnection linkage 800 interconnects the rotary latches 600, 600′ for concurrent unlatching operation, as will be explained.

Turning now to a more detailed discussion of the components of the door lock system 20, and referring particularly to FIGS. 1 and 6, the interior operating handle assembly 100 is of a commercially available type sold by Eberhard Manufacturing Company, Cleveland, Ohio 44136, under the model designation 1-29908. A substantially identical unit also is available from A. E. Merchandising Limited, Kings Norton, Birmingham B30 3AR, England, under the same model designation, namely 1-29908. While the construction and arrangement of components of the commercially available interior handle assembly 100 form no part of the present invention, a brief description of selected features thereof will be provided in order to enable the reader to better understand and appreciate how the rotary latch and connection linkage assembly 500 serve to accommodate and enhance characteristics of the interior operating handle assembly 100.

The interior handle assembly 100 includes a housing 102 which is preferably formed from metal or plastics material as a cast or molded structure. An operating handle 104 is pivotally mounted on the housing 102 for movement between a "normal" seated or nested position (as depicted in FIGS. 1, 3, 4 and 6) to an operating position (as depicted in FIGS. 2 and 5). Referring to FIG. 6, an arm 106 projects rearwardly with respect to the housing 102. The arm 106 is an integral projecting part of the handle 104 (which does not appear in FIG. 6), and moves with the handle 104 when the handle 104 is pivoted relative to the housing 102.

An operating rod 510 has one end region that is pivotally connected to the arm 106 to couple the operating rod 510 to the handle 104 for movement in response to pivotal movement of the handle 104 with respect to the housing 102. A compression coil spring 112 surrounds a portion of the operating rod 510 and engages a portion of the handle assembly 100 for biasing the operating rod 510 in a direction that tends to bias the handle 104 toward its seated or nested position, i.e., away from its operating position, whereby the handle 104 tends to remain seated or nested with respect to the housing 102.

The exterior operating handle assembly 200 is of a commercially available type sold by Eberhard Manufacturing Company, Cleveland, Ohio 44136, under the model designations 1-25653 and 1-25654 (for left and right hand units, respectively). Substantially identical units also are available from A. E. Merchandising Limited, Kings Norton, Birmingham B30 3AR, England, under the same model designations, namely 1-25653 and 1-25654 (for left and designations right hand units, respectively). While the construction and arrangement of components of the commercially available exterior handle assembly 200 form no part of the present invention, a brief description of selected features thereof will be provided in order to enable the reader to better understand and appreciate how the rotary latch and connection linkage assembly 500 serve to accommodate and enhance various characteristics of the exterior operating handle assembly 200.

Figure 7:
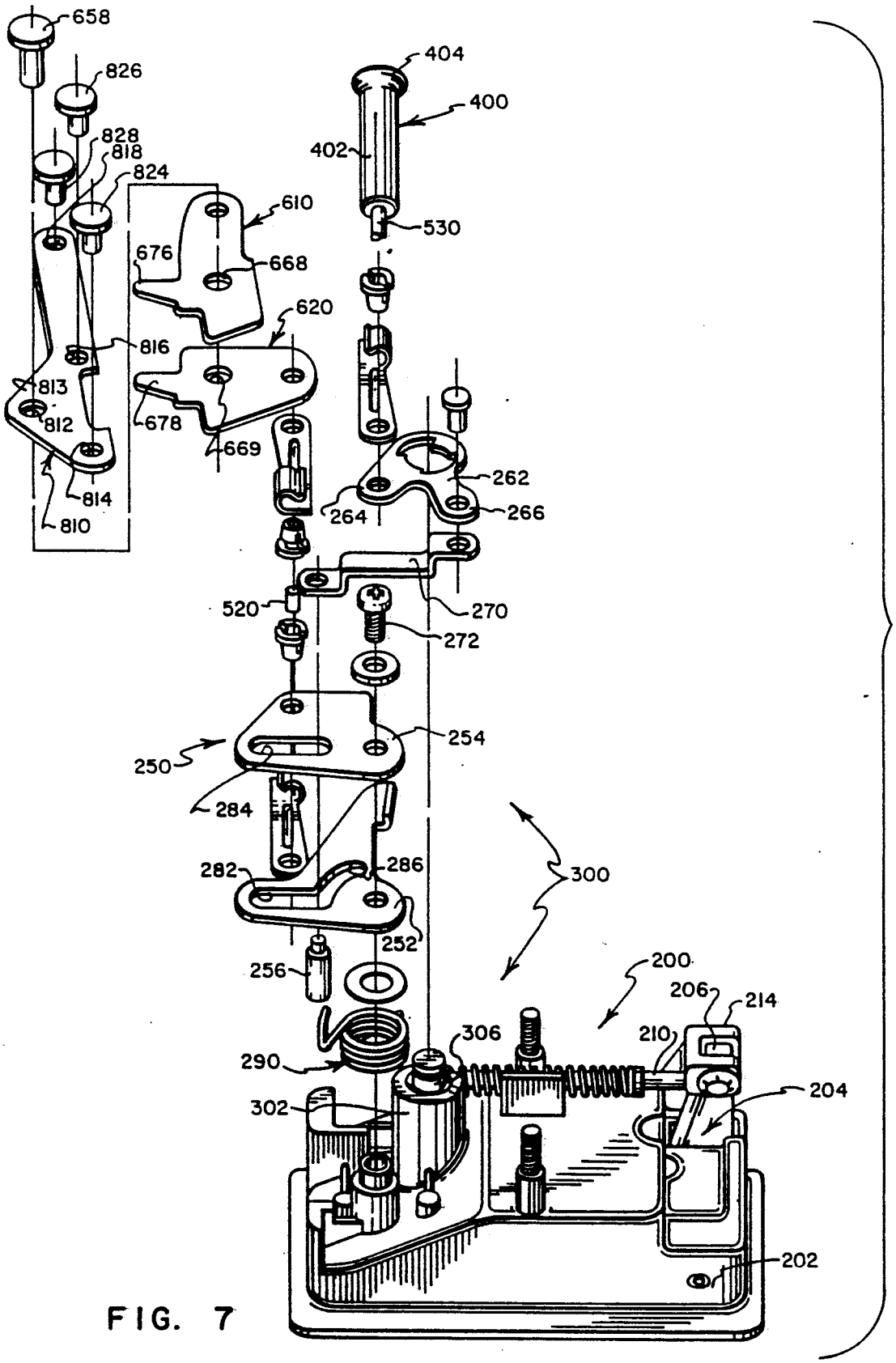

Referring primarily to FIG. 7 in conjunction with FIGS. 1–6, the exterior operating handle assembly 200 includes a housing 202 which is preferably formed from metal or plastics material as a cast or molded structure. Referring to FIG. 6, an operating handle 204 is pivotally mounted on the housing 202 for movement between a "normal" seated or nested position (as depicted in FIGS. 1, 3, 5, and 6) to an operating position (see FIGS. 2 and 4). Referring to FIG. 7, the handle 204 has an arm portion 206 that projects rearwardly with respect to the housing 202. A primary operating rod 210 of elongate configuration has one end region 214 that is pivotally connected to the arm portion 206. Referring to FIGS. 1–5, an opposite end region 216 of the primary operating rod 210 projects through a hole formed in a rearwardly projecting housing formation 208 to mount the rod 210 on the housing 202 for translation in response to pivotal movement of the handle 204 with respect to the housing 202. The rod 210 has an end that defines a rounded engagement surface 220.

A compression coil spring 212 surrounds a central portion of the operating rod 210 and engages the housing projection 208. The spring 212 biases the operating rod 210 in a direction that tends to bias the handle 204 in a direction toward its seated or nested position, i.e., away from its operating position, whereby the handle 204 tends to remain seated or nested with respect to the housing 202.

Referring to FIG. 7, an assembly 250 of relatively movable components is provided on the back of the housing 202 for selectively drivingly connecting the primary operating rod 210 to an external operating rod 520, and for interconnection with the exterior key lock cylinder 300. The assembly 250 includes primary and secondary operating levers 252, 254 that cooperate with a connecting pin 256 to transfer motion from the primary operating rod 210 to the exterior operating rod 520, as will be explained. However, before further describing the components of the assembly 250 and their interconnecting functions, features of the exterior key lock cylinder assembly 300 will be discussed.

Referring to FIGS. 6 and 7, the exterior key lock cylinder assembly 300 preferably is of a type that has a cylinder housing 302 which is formed as an integral part of the housing 202 of the exterior operating handle assembly 200. The assembly 300 has a key-receiving cylinder plug 306 that is journaled by the cylinder housing 302. While the type of key lock assembly 300 that is depicted in the drawings is sold as an integral subassembly of the exterior operating handle assembly 200, it will be understood that substitute or similar forms of key cylinder assemblies may be selected for use from any of a wide variety of commercially available units. Typically, such units have internally carried tumblers (not shown) or other suitable locking structure with common basic characteristics 1) that will permit the cylinder plug 306 to be rotated with respect to the housing 302 only in response to insertion into the plug 306 and rotation therewith of an appropriately configured key (not shown); 2) that define a single relative orientation of the plug 306 and the housing 302 that must be achieved before the key 308 can be removed from the plug 306; and, 3) that permit the plug 306 to be rotated through a range of movement extending through about seventy five degrees of rotation in either of two directions as measured from the orientation of the plug 306 relative to the housing 302 wherein key removal from the plug 306 is permitted.

Referring to FIGS. 1–5, 6 and 7, a feature of the key lock cylinder assembly 300 is that the rotatable plug 306 (best seen in FIGS. 6 and 7) is drivingly connected to an L-shaped crank arm 262 which can be thought of as comprising an element of the assembly 250 (see FIG. 7). Referring principally to FIG. 7, the crank arm 262 has one leg 264 which connects with the exterior control rod 530, and another leg 266 that is connected by a link 270 to the connecting pin 256. The connecting pin 256 serves to provide or prohibit a driving connection between the primary and secondary operating levers 252, 254. A fastener 272 pivotally connects the levers 252, 254 to the housing 202.

The levers 252, 254 have overlying radially extending slots 282, 284 formed therein that permit the connecting pin 256 to move from a connecting position shown in FIGS. 3, 4 and 5 to a disconnecting position shown in FIGS. 1, 2 and 6. The primary operating lever 252 has an arcuate slot portion 286 that connects with the inner end region of its radially extending slot 282, wherein the connecting pin 256 can move freely without causing a driving connection to be established between the levers 252, 254 when the connecting pin 256 is caused to be positioned by the link 270 in its disconnecting position, as is shown in FIG. 2 where operation of the external operating handle assembly 200 is shown to have no influence on the external operating rod 520 that would tend to move the exterior release arm 620 to unlatch the latch unit 600.

While the entire exterior operating handle assembly 200 as shown in FIG. 7 is a commercially available unit (for which substantially equivalent and alternate forms of handle assemblies can be substituted as may be preferred) that therefore need not be described in detail, one further feature will be discussed, namely the provision of a multipurpose torsion coil spring 290 that is interposed between the housing 202 and the levers 252, 254 to bias the levers 252, 254 in a clockwise direction as viewed in FIGS. 1–5, and to thereby bias the external operating rod 520 in an upward direction. This feature helps to retain the external operating rod 520 from sliding downwardly when the interior operating handle assembly 100 operates the interior latch release arm 610, whereby the external latch release arm 620 is no longer caused to be biased in a direction that would tend to cause the external operating rod 520 to remain in its upward position. This feature (namely the provision of the torsion coil spring 290) is desirable from the viewpoint that it helps to keep such components as the levers 252, 254 and the external operating rod 520 from becoming loose and being subject to vibration.

Referring to FIGS. 1–6, the interior sill button 400 is of a commercially available type sold by Eberhard Manufacturing Company, Cleveland, Ohio 44136, under the model designation 7-26668. A substantially identical unit is also available from A. E. Merchandising Limited, Kings Norton, Birmingham B30 3AR, England, under the same model designation, namely 7-26668. While the construction and arrangement of the commercially available interior sill button 400 forms no part of the present invention, a brief description thereof will be provided in order to enable the reader to better understand and appreciate how the connection linkage assembly 500 accommodates and utilizes the button 400 to in conjunction with other components of the door lock system 20.

The interior sill button 400 is an elongate one-piece member that preferably is formed from rigid plastics material. The sill button 400 has a hollow lower end region 402 that is press-fit or threaded onto the operating rod 530, and an enlarged upper end region 404 that projects above the window sill 12 for actuation by an operator's hand. When the sill button 400 is depressed, as is shown in FIG. 1, the door lock 10 is "locked" such that attempted operation of the exterior handle assembly 200 will be ineffectual (as is illustrated in FIG. 2) to effect unlatching of the latches 600, 600'; however, when the sill button 400 is depressed, the interior handle assembly 100 may be operated to effect concurrent unlatching of the latches 600, 600', as is shown in FIG. 2. When the sill button 400 is raised, as is shown in FIGS. 3-5 the door lock 20 is "unlocked" so that operation of either of the handle assemblies 100, 200 will operate to unlatch the rotary latch units 600, 600', as is shown in FIGS. 4 and 5.

A feature of the elements of the exterior handle operating assembly 200 is that locking and unlocking movements of the key cylinder 300 (which sets elements of the exterior handle operating assembly 200 to enable and disable the exterior handle assembly 200 from moving the exterior operating rod 520) cause corresponding vertical movements of the exterior control rod 530 to position the sill button 400 so that the position of the sill button 400 is indicative of the "locked" or "unlocked" condition of the door lock system 20 (i.e., a raised sill button 400 indicates that the system 20 is "unlocked" to enable operation of the exterior handle assembly 200 to "unlatch" the latch assemblies 600, 600', while a lowered sill button 400 indicates that the system 20 is "locked" to prevent unlatching of the latches 600, 600' by the exterior handle assembly 200).

Because the rotary latch units 600, 600' are substantially identical (except for the fact that the units 600, 600' are "left" and "right" hand assemblies, respectively, and except for the inclusion in the latch unit 600' of a pair of release levers 610, 620 that are not present in the latch unit 600'), only the components of the latch 600 will be described in detail. It will be understood that such components of the latch 600' as correspond to components of the latch unit 600 are designated in the drawings by corresponding numerals bearing a "prime" mark.

Figure 8:
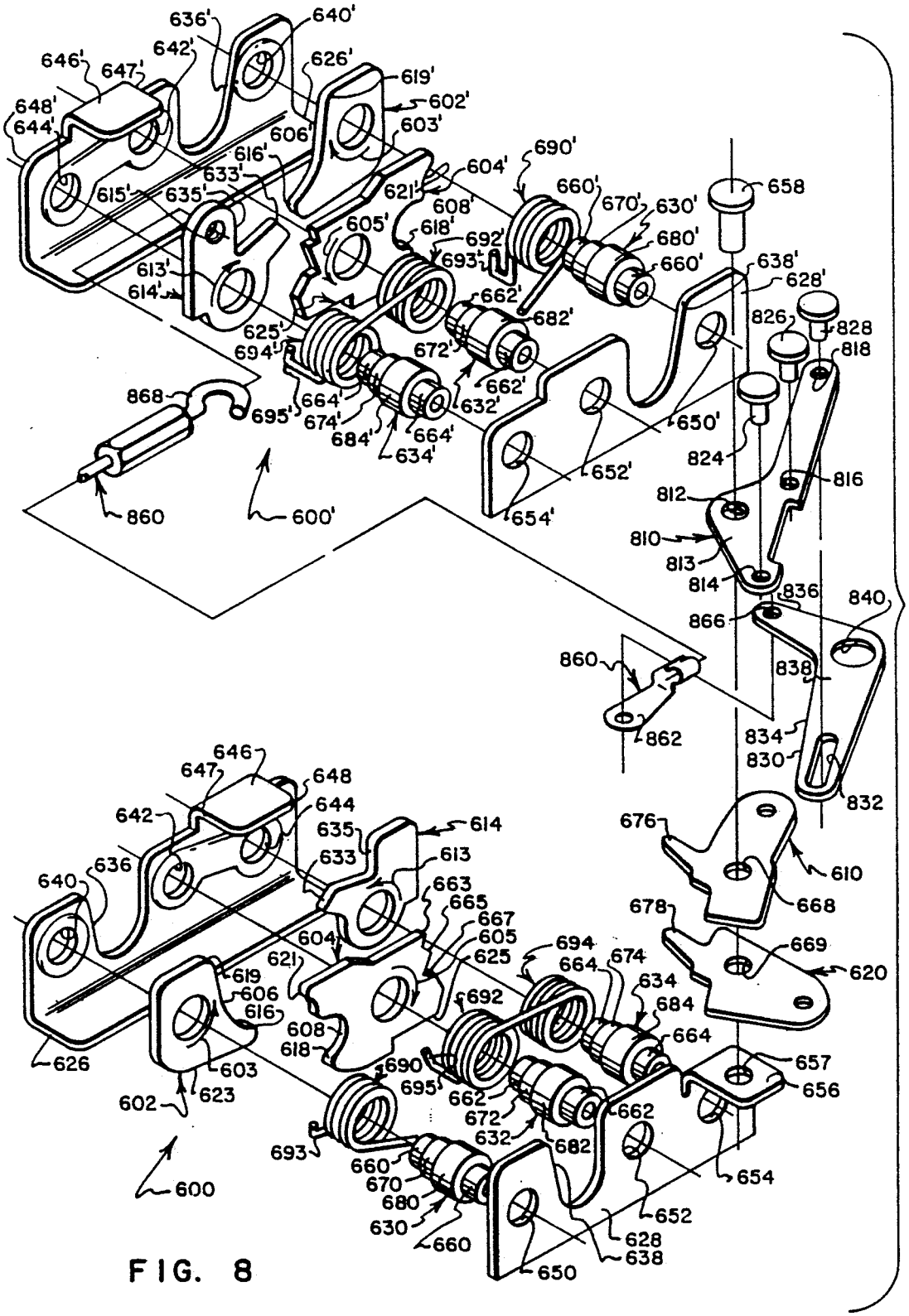
Figure 9:
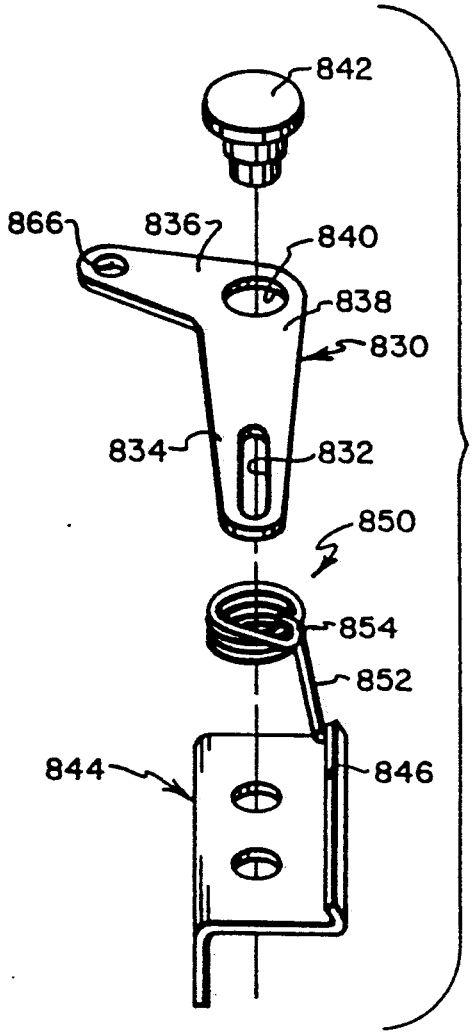
Figure 10:
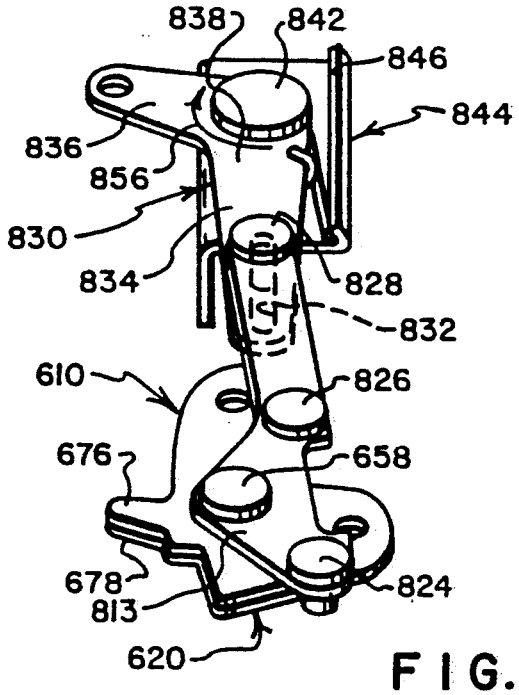
Figure 11:
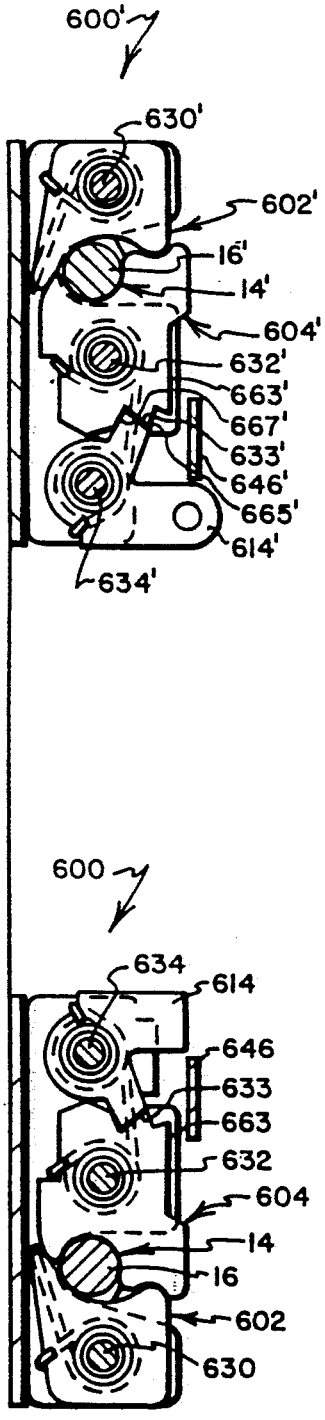
Figure 12:
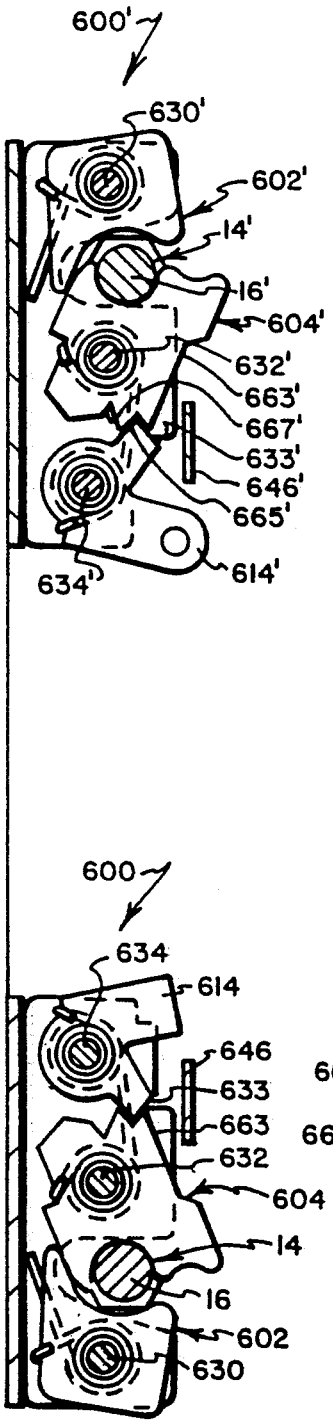
Figure 13:
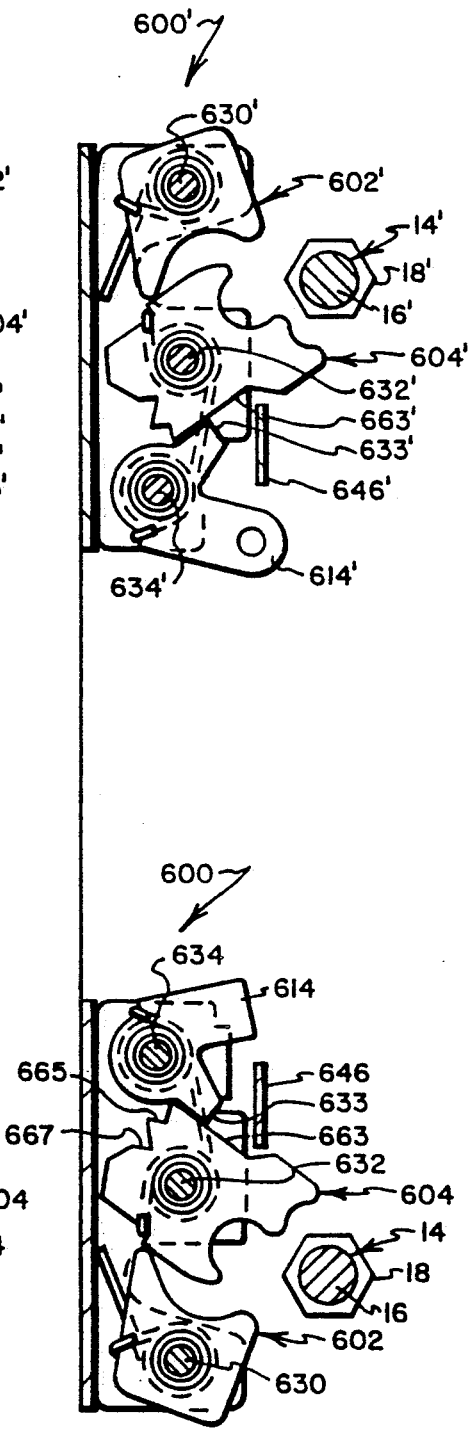

Referring to FIG. 8 in conjunction with FIGS. 10-12, the rotary latch unit 600 has a housing which is formed as an assembly of two side plates 626, 628 and three bushings 630, 632, 634. The bushings 630, 632, 634 extend through aligned holes 640, 642, 644 and 650, 652, 654 that are formed in the side plates 626, 628. Reduced diameter end regions 660, 662, 664 of the bushings 630, 632, 634 are crimped (not shown) into engagement with the side wall plates 626, 628 to form a rigidly assembled housing. The bushings 630, 632, 634 have stepped central regions with relatively small diameter portions 670, 672, 674 and relatively large diameter portions 680, 682, 684.

The rotary latch bolts 602, 604 and the pawl 614 are pivotally mounted on the small diameter portions 670, 672, 674, respectively, for rotary movement between fully latched positions shown in FIG. 10, and unlatched positions shown in FIG. 12. Intermediate "preliminary" latching positions of these members are illustrated in FIG. 11.

Torsion spring coils 690, 692, 694 are reeved around the large diameter portions 680, 682, 684 of the bushings 630, 632, 634 to bias the rotary latch bolts 602, 604 and the pawl 614 in directions that are indicated, respectively, by arrows 603, 605 and 613 in FIG. 8.

Aligned notches 636, 638 are formed in the side plates 626, 628. The notches 636, 638 are of such size and configuration as will permit the central portion 16 of the striker pin 14 to be relatively loosely received therein. An inwardly turned tab 646 is formed integrally with the side plate 626. A pair of abutment surfaces 647, 648 are defined on opposite sides of the inwardly turned tab 646.

The latch unit 600 (but not the latch unit 600') has an outwardly turned tab 656 that is formed as an integral part of the side plate 628. A hole 657 is formed through the tab 656. A mounting pin or rivet 658 extends through the hole 657 and through aligned holes 668, 669 that are formed in the release levers 610, 620 to pivotally mount the release levers 610, 620 on the latch unit 600. Release projections 676, 678 are formed on the levers 610, 620 for engaging the pawl 614 to move it to release its retaining engagement with the rotary latch bolt 604 and to thereby release or "unlatch" the latch bolts 602, 604 for movement to their unlatched position under the influence of the torsion coil springs 690, 692.

The latch unit 600' (but not the latch unit 600) has a hole 615' formed through the pawl 614' to receive a hook-shaped upper end region 868 of an elongate connecting linkage element 860 that serves to move the pawl 614' to release its engagement with the rotary latch bolt 604' to "unlatch" the rotary latch unit 600' in unison with the unlatching of the rotary latch unit 600, as will be explained.

Referring to FIGS. 10-12 in conjunction with FIG. 8, the rotary latch bolt members 602, 604 are provided with concave recesses 606, 608, stop formations 616, 618, cam surfaces 619, 621, and spring end engagement surfaces 623, 625. The recesses 606, 608 are operable to receive the striker 14 as the door 10 is moved toward its closed position. The stop formations 616, 618 engage each other as the door 10 reaches its closed position, thereby preventing further rotation of the latch bolts 602, 604 in a latching direction of movement. The cam surfaces 619, 621 are configured to cooperate with each other to facilitate concurrent movement of the latch bolt members 602, 604 between their latched and unlatched positions. The spring end engagement surfaces 623, 625 engage spring end portions 693, 695 which project from the spring coil portions 690, 692.

A plurality of abutment formations 663, 665, 667 are provided on one side of the latch bolt 604. The pawl 614 has a tooth formation 633 which is selectively engageable with the abutment formations 663, 665, 667. The pawl 614 of the rotary lock unit 600 has a projection 635 which may be engaged by the abutment surface 648 on the tab 646 and by the release levers 610, 620; this is in contrast to the hole 615' that is formed through the pawl 614' to permit the upper end region of the connecting link element 860 to connect directly to the pawl 614' to operate the pawl 614' without the need for one or more pawl-operating levers (such as the levers 610, 620). The pawl 614 is biased by the coil spring portion 694 toward positions which will bring the tooth 633 into engagement with one of the abutment formations 663, 665, 667.

The operation of the rotary latch unit 600 is best understood by referring to the sequence of positions illustrated in FIGS. 11-13. In FIG. 13, the unlatched position of the rotary latch bolts 602, 604 and of the pawl member 614 are shown. In this position, the pawl tooth 633 engages the abutment formation 663. Beginning with the members 602, 604, 614 positioned as shown in FIG. 13, when the door 10 is moved toward the striker 14, and the striker pin 14 moves into the side wall notches 636, 638 and into the latch bolt recesses 606, 608. As the striker 14 continues to move inwardly with respect to the notches 636, 638, the rotary latch bolts 602, 604 are rotated toward the intermediate position shown in FIG. 12. As soon as the latch bolt members 602, 604 reach the intermediate position shown in FIG. 12, the pawl tooth 633 pivots under the influence of the coil spring portion 694 into engagement with the abutment formation 665. Continued inward movement of the striker 14 into the notches 636, 638 causes the rotary latch bolts 602, 604 to further rotate toward their latched positions as shown in FIG. 11. As soon as the rotary latch bolt members 602, 604 are in their latched positions, the stop formations 616, 618 engage each other to prevent further latching rotation of the latch bolt members 602, 604, and the pawl tooth 633 engages the abutment formation 667 thereby releasably retaining the rotary latch bolts 602, 604 in their latched positions.

In order to open the door 10, one of the interior and exterior operating handle assemblies 100, 200 is operated to cause one of the release levers 610, 620 of the latch unit 600 to pivot about the axis of the rivet 658. As one of the release levers 610, 620 pivots about the axis of the rivet 658, its associated operating projection 676 or 678 is brought into engagement with the projection 635 on the pawl 614, causing the pawl 614 to rotate to bring the tooth formation 633 out of engagement with the abutment formations 665, 667, thereby permitting the rotary latch bolt members 602, 604 to move to their unlatched positions under the influence of the coil spring portions 690, 692.

To effect concurrent unlatching of the latch units 600, 600', the rotary latch unit interconnection linkage 800 is provided to drivingly interconnect the pawls 614, 614' of the rotary latch units 600, 600' for concurrent unlatching movement (i.e., to release and rotate the pawls 614, 614' in unison to effect the type of unlatching movements that are described above in conjunction with the operation of the latch unit 600). Referring to FIGS. 1–6 in conjunction with the enlarged, exploded views of FIGS. 7 and 8, the interconnection linkage 800 includes an operating arm 810 that is pivotally connected to the outwardly turned tab 656 of the rotary latch unit 600 by the same mounting pin or rivet 656 that pivotally mounts the latch release arms 610, 620 on the unit 600.

Referring to FIGS. 7 and 8, the operating arm 810 is of generally elongate configuration but has something of an offset, doglegged shape. A hole 812 is formed through an offset portion 813 of the operating arm 810 to receive the mounting pin or rivet 656. Three in-line holes 814, 816, 818 are formed through the operating arm at spaced locations along its length to rigidly receive and immovably mount three headed pins 824, 826, 828.

The pins 824, 826, 828 extend through the holes 814, 816, 818, respectively, and project beyond one side of the arm 810 for drivingly engaging other operating elements. The pins 824, 826 are arranged to extend into the paths of unlatching movement of the latch release arms 620, 610, respectively, so as to cause the operating arm 810 to be pivoted in response to unlatching movement of either of the latch release arms 620, 610. As is best seen in FIGS. 1, 3 and 6, the operating arm 810 normally assumes an upstanding orientation tilted slightly left of vertical. However, as is illustrated in FIGS. 2, 4 and 5, in the event that either of the latch release arms 620, 610 is pivoted to effect unlatching of the latch unit 600, the operating arm 810 is caused to be rotated clockwise to a position inclined rightwardly of vertical.

The pin 828 extends into an elongate slot 832 formed in a motion transfer arm 830. The arm 830 is of generally L-shaped configuration, having leg portions 834, 836 that project from a central region 838 where a hole 840 is formed through the arm 830 to receive a mounting pin 842 that pivotally mounts the arm 830 on a bracket 844. The bracket 844 is configured for mounting on the door 10 that supports the rotary latch units 600, 600'. The bracket 844 has an inturned flange portion 846 that engages one end region 852 of a torsion coil spring 850 which is coiled about the mounting pin 842. An opposed end region 854 of the spring 850 engages the arm 830 to bias the arm 830 in a clockwise direction, as indicated by an arrow 856 in FIG. 10.

Referring to FIGS. 1–6 and 8, an elongate connecting link 860 has an end region 862 that connects with a pin 864 which extends through a hole 866 formed in the outer end region of the leg portion 836 of the arm 830. The link 860 has a hook shaped upper end region 868 that extends through the hole 615' that is formed in the pawl 614' for operating the pawl 614' to unlatch the rotary latch unit 600', as has been described.

The biasing action of the torsion coil spring 850 serves to counteract the weight of the connecting link 860 and thereby prevents the weight of the connecting link 860 from operating the pawl 614' to unlatch the latch unit 600'. Also, the biasing action of the torsion coil spring 850 serves to prevent rattling vibratory movements of the link 860 and the arms 810, 830.

The elongate slot 832 that is formed in the leg 834 of the arm 830 is needed inasmuch as the arms 810, 830 are configured and mounted for movement in such a way that the pin 828 needs to move along the length of the leg 834 during concurrent rotation of the arms 810, 830 between their normal position (see FIGS. 2, 4 and 5) and their unlatching position (see FIGS. 1, 3 and 6).

Referring to FIG. 14, a lock system 20" is shown that illustrates a preferred manner in which features of the invention of the referenced Plural Point Locking System Cases can be utilized to convert a single-rotary-latch system to a plural-rotary-latch system. The system 20" is identical in all respects to the latch system that is described and illustrated in FIGS. 1–13, except for the addition thereto of a second rotary latch 600"' together with such latch interconnection components 800" as have already been described for enabling a pair of rotary latches 600", 600"' to operate in unison to effect concurrent unlatching to release a latched door 10". Viewed in a different way, the system 20" will be seen to be substantially identical in structure and operation to the system 20 described above except for the incorporation into the system 20" of a connection linkage unit 700" that serves to provide a "childproofing" feature (i.e., a feature whereby, when the system 20" is "locked" (as by operation of either a key cylinder plug 306 that is associated with an exterior handle assembly 200", or by operation of a sill button 400"), the interior handle assembly 100 is prevented from effecting unlatching of the door if it is operated without first unlocking the lock as by operating the key cylinder plug 306 or by raising the sill button 400").

While reference is made herewith to the disclosure of the referenced utility Parent Cases for a more complete discussion of the features of the linkage unit 700" and its hookup and function, a brief description will be provided of several of its attributes. In FIG. 14 reference numerals designating components of the system 20" are assigned in a manner that correspond to the assignment of numerals that are used herein to designate components of the above-described system 20; moreover, the same reference numerals as are used in FIG. 14 are employed in the referenced utility Parent Cases (except that the numerals used in FIG. 14 typically have "double prime"-marks added thereto).

Referring to FIG. 14 (and to the disclosure of the referenced utility Parent Cases), a feature of the connection linkage unit 700'' lies in its provision of a compact array of overlying, pivotally mounted levers 702'', 704'', 706'', 708'' that connect with opposed operating rods 510'' and 510''', and with opposed control rods 530'' and 540''. The control rods 530'', 540'' operate to enable and disable the interior operating handle assemblies 100'', 200'' from operating the interior and exterior release levers 610'', 620''. The operating rods 510'', 510''' effectively comprise segments of what has been described in conjunction with the system 20 as a single operating rod 510 that (transmits forces through the connecting lever unit 700'' and thereby) operates the interior release lever 610'' of the rotary latch unit 600'' in response to operation of the interior handle assembly 100'', but only when the door 10'' is "unlocked." The connection linkage 700'' also includes a separate exterior operating rod 520'' that connects the exterior operating handle assembly 200'' with the exterior release lever 620'' for unlatching the rotary latch unit 600'' in response to operation of the exterior handle assembly 200'', but only when the door 10'' is "unlocked."

In operation, the elements mentioned above cooperate to assure that: 1) when the door 10'' is "latched" but not "locked," either of the handle assemblies 100'', 200'' may be operated to unlatch the door 10''; 2) when the door 10'' is both "latched" and "locked," neither of the handle assemblies 100'', 200'' may be operated to unlatch the door 10; and, 3) such locking and unlocking movements as are executed by the key cylinder 300'' will cause corresponding movements of the sill button 400'' between its locked and unlocked positions, whereby the positioning of the sill button 400'' is operative to provide an indication of the "locked" and "unlocked" status of the door lock system 20''.

To the extent that a further discussion of features of the system 20'' may interest the reader, the disclosures of the referenced utility Parent Cases (incorporated herein by reference) provide full descriptions and drawings that disclose other features of the structure and operation of the system 20''.

Because the interconnected manner in which the rotary lock units 600'', 600''' operate in the system 20'' does not differ from the manner in which the interconnected rotary lock units 600, 600' operate in the system 20, no further description needs to be provided here to enable one skilled in the art to understand how features of the foregoing system and its components can be utilized to convert a single latch system to a plural latch system. While, in theory, an unlimited number of rotary latch units can be coupled to the described latch 600 of the system 20 (or the described latch 600'' of the system 20''), as a practical matter, the force that is needed to effect unlatching operation of a typical rotary latch 600, 600', 600'' or 600''' is sufficient in magnitude that the number of rotary latches that can be incorporated in a single system ordinarily is limited to two or three. Dual latch systems of the type that have been described and illustrated herein have been found to work quite nicely in that they require a very reasonable application of force to effect unlatching operation in most typical types of installations.

As will be apparent from the foregoing description, the invention of the referenced Plural Point Locking System Cases provides a door lock system that utilizes a novel and improved rotary latch inter-connection linkage for permitting spaced rotary latches to be utilized to effect secure latching and locking of a closure in place on a vehicle or the like, with features of the latch interconnection linkage being usable with a wide variety of rotary latch systems to enable conversion of single-latch systems to plural-latch systems without a loss of other advantageous features of the various systems. Moreover, latch interconnection components that embody the preferred practice of the invention of the referenced Plural Point Locking System Cases can be utilized with commercially available door lock operating and control hardware of a wide variety of forms, and with the hardware arranged in a wide variety of orientations, as may be appropriate for use with, a wide variety of door structures and door installation arrangements.

With the foregoing as background, reference is made to FIGS. 15–18 wherein features that form the subject matter of a co-pending application, namely the referenced Double-Wedge Parent Case, are illustrated as they apply to a rotary latch of the type that is referred to above by the numeral 600, and to a striker pin of the type that is referred to above by the numeral 14. While what is shown and described in conjunction with FIGS. 15–18 corresponds to the latch 600 and the striker pin 14, it will be understood by those skilled in the art that right-to-left and left-to-right reversals can be made of the components that are described and depicted, whereby the system of the present invention is equally applicable to such components as the latch 600' and the striker pin 14', etc.

Figure 15:
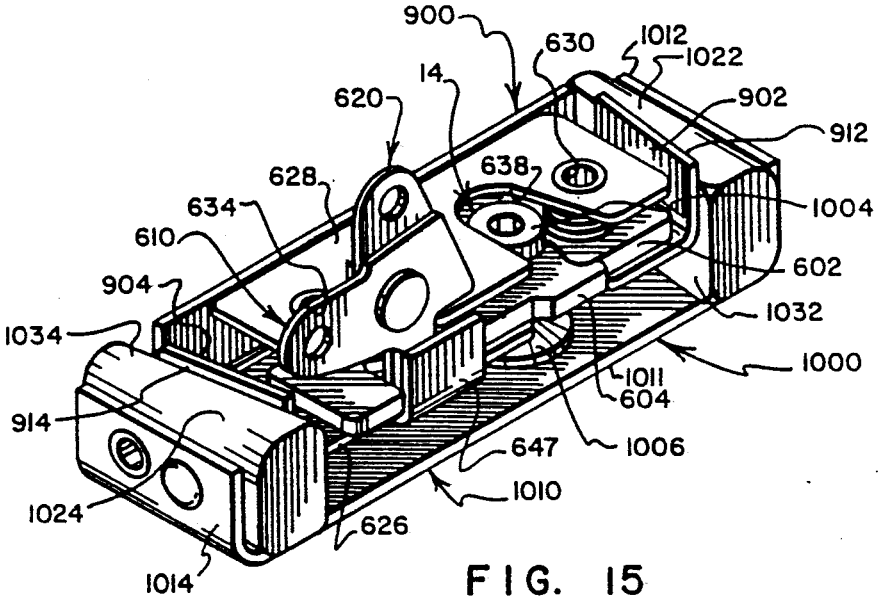
Figure 16:
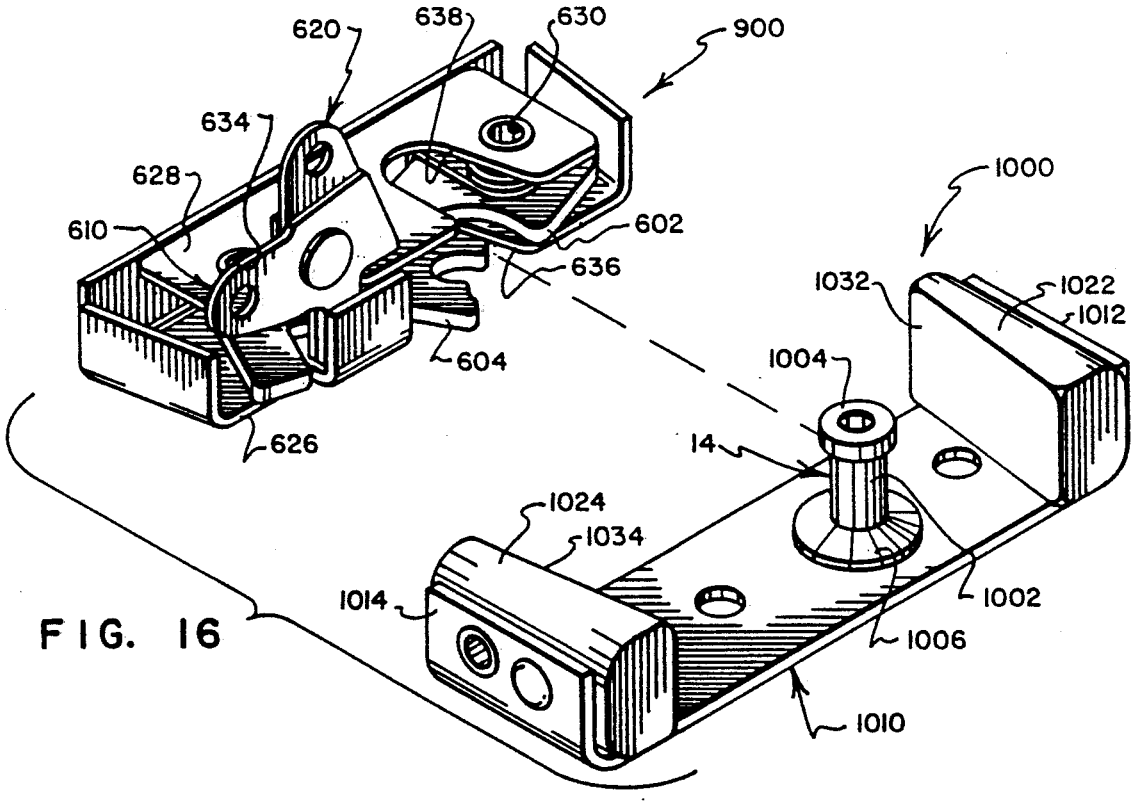

Referring to FIG. 16, components that embody the preferred practice of the invention of the Double-Wedge Parent Case include a rotary latch assembly 900 and a striker assembly 1000. The rotary latch assembly 900 has a housing and operating components that are identical to those which are depicted in the bottom half of FIG. 8 (whereby the same reference numerals that are used in FIG. 8 also are employed in FIGS. 15–18 to designate functionally equivalent components), with the exception that the housing side plate 626 is of greater length and has inwardly turned edge portions including end regions 902, 904 that define a pair of opposed, outwardly facing end surfaces 912, 914 that are "tapered" or "inclined" so as to extend in imaginary planes that intersect at a location toward which the U-shaped notches 636, 638 face as they open through a forward side of the latch housing plates 626, 628 to receive the striker pin 14.

The striker pin 14 has a cylindrical receiving portion 1002 that extends between an enlarged end region 1004 and an enlarged mounting flange 1006. An elongate bracket 1010 is positioned adjacent the mounting flange 1006. In preferred practice, the bracket 1010 is of U-shaped configuration, having a central region 1011 that mounts the striker pin 14 and that interconnects a pair of opposed end regions 1012, 1014 that extend substantially parallel but in planes that are spaced by the central region 1011. A pair of wedge blocks 1022, 1024 are mounted on the end regions 1012, 1014 so as to define a pair of "tapered" or "inclined" wedge surfaces 1032, 1034 are provided that face inwardly on opposite sides of the bracket 1010 to receive and engage the "tapered" or "inclined" surfaces 912, 914 of the latch bracket side plate 626 when the latch 900 is moved into latching engagement with the striker assembly 1000.

Figure 17:
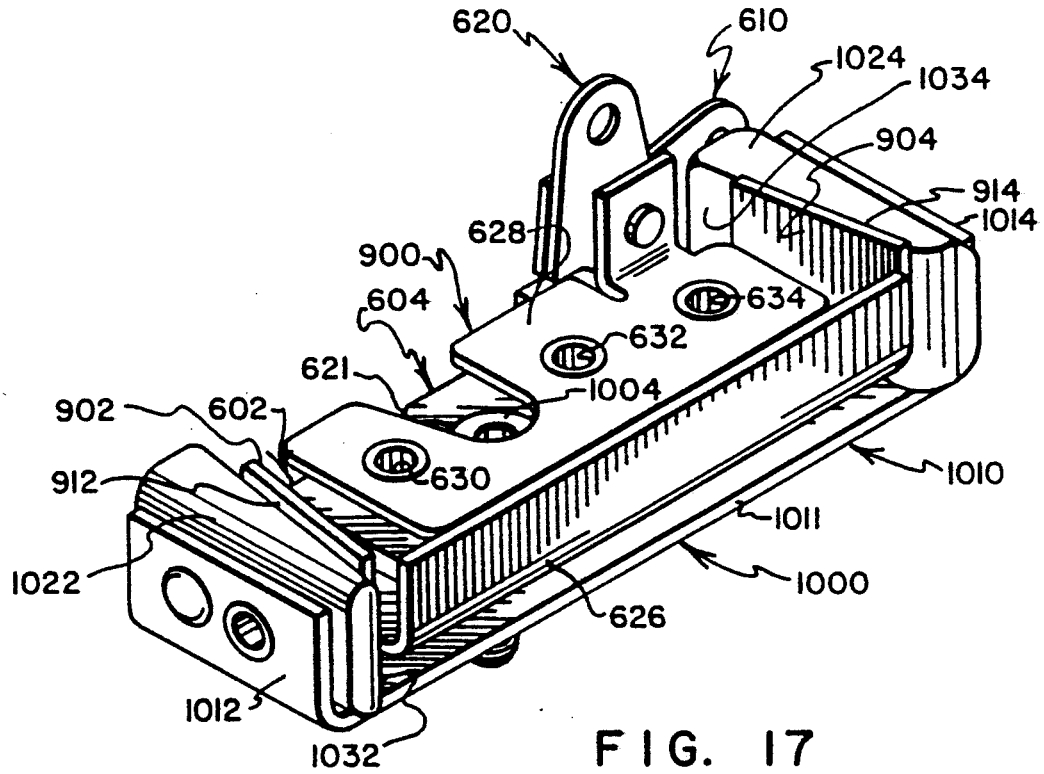
Figure 18:
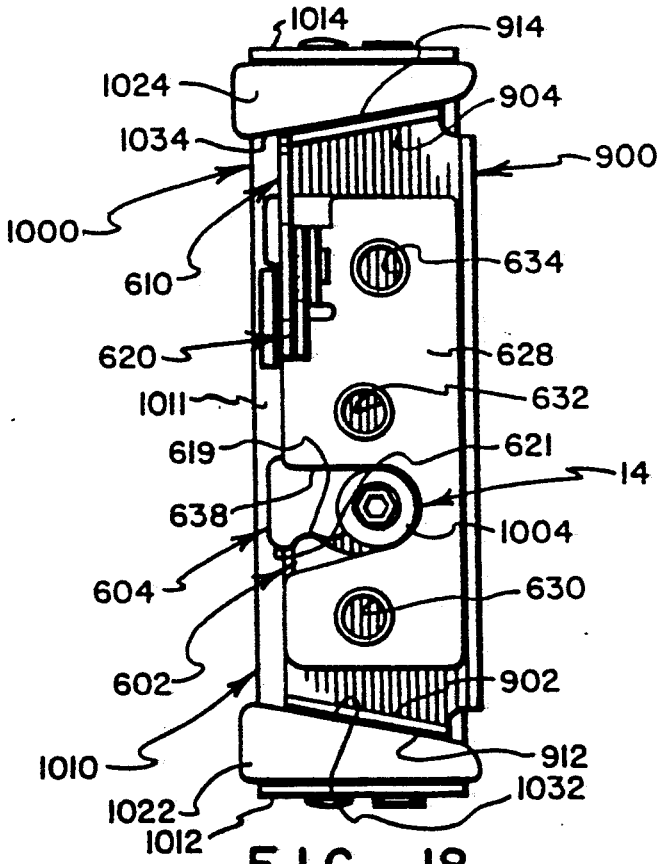

Latched engagement of the latch assembly 900 with the striker assembly 1000 is depicted in FIGS. 15 and 17–18 In FIG. 16 the assemblies 900, 1000 are shown disengaged, with components of the latch assembly 900 "unlatched" in the manner that has been described in conjunction with the foregoing discussion of the latch 600.

The wedge blocks 1022, 1024 preferably are formed from a relatively rigid, high density plastics material such as nylon, and are rigidly connected to the end regions 1012, 1014. In preferred practice, the mounting of the wedge blocks 1022, 1024 onto the end regions 1012, 1014 is effected by providing holes that extend through the wedge blocks 1022, 1024 to receive rivets or other conventional fasteners that may be used to secure the wedge blocks 1022, 1024 to the end regions 1012, 1014. The angle of inclination of the wedge surfaces 1032, 1034 relative to the end planes of the regions 1012, 1014 preferably is about 10 to 12 degrees, so that the included angle between the wedge surfaces 1032, 1034 is about 66 to 70 degrees. So that no unintended "wedging" action takes place that causes the latch housing plate 626 to become lodged or otherwise jammed between the wedge blocks 1022, 1024, the angles of inclinations of the inclined end surfaces 912, 914 is selected to correspond to the angles of inclinations of the associated wedge surfaces 1032, 1034.

By the arrangement described above, elongate latch housings are provided that are received within striker assemblies that serve to guide the latch housings into proper aligned relationship with the striker assemblies during "latching" movements, and that serve to rigidly and securely maintain aligned engagement of the latch assemblies with the striker assemblies when "latched." The type of secure latching engagement that is established, with the latch bolts 602, 604 extending closely about the cylindrical receiving portion 1002 of the striker pin 14 (at a location between the enlarged diameter formations 1004 and 1006) resists relative movements between door and door frame structures on which the latch and striker assemblies are mounted, respectively.

Turning now to improvement features that comprise the subject matter of the present invention and that preferably are utilized in combination with locking systems of the type that form the subject matter of the utility Parent Cases, examples of which are described above and depicted in FIGS. 1–14, reference is made to FIGS. 19–22 wherein improvement features of the present invention are illustrated as they apply to a rotary latch of the type that is described above and referred to above by the numeral 600, and to a striker pin of the type that is described above and referred to above by the numeral 14. While latch components that are shown and described in conjunction with FIGS. 19–22 corresponds to the latch 600 and the striker pin 14, all of the reference numerals that are used in FIGS. 19–22 (including numerals that designate components and features that have configurations and/or that serve functions that correspond to those that have been described above) include an asterisk (*) so that what is referred to in the description that follows will not be confused with what has been described above. Those skilled in the art will understand that right-to-left and left-to-right reversals can be made of the components and combinations of features that are described and depicted in conjunction with FIGS. 19–22.

Figure 20:
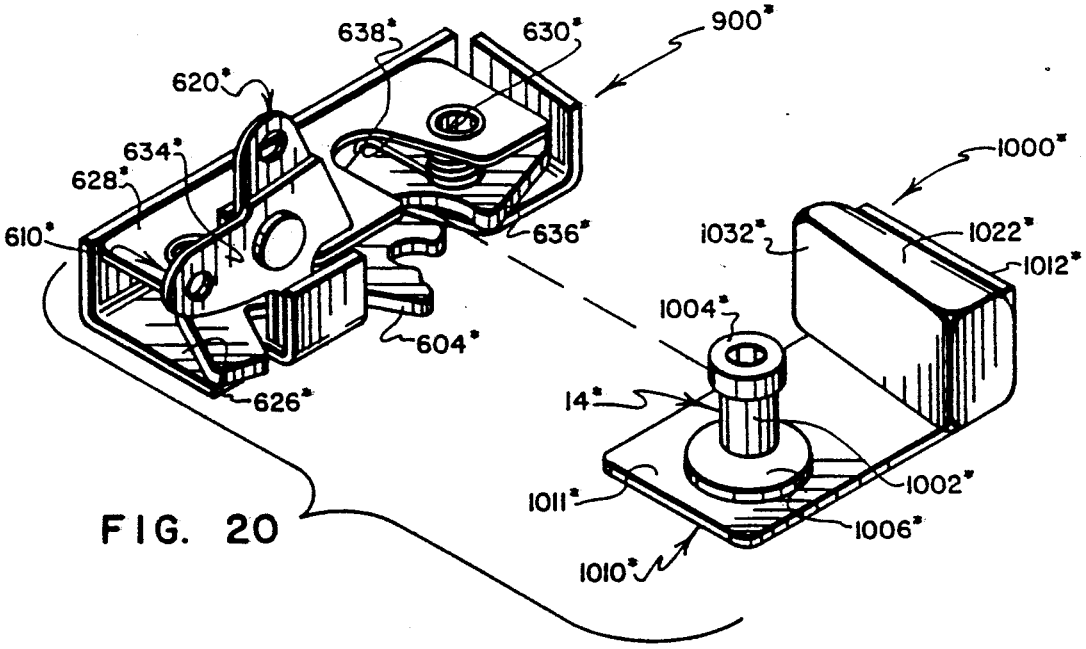
FIG. 20 is a perspective view similar to FIG. 19 but with the latch and striker separated, and with the latch "unlatched;"

Referring to FIG. 20, components that embody the preferred practice of the present invention include a rotary latch assembly 900* and a striker assembly 1000*. The rotary latch assembly 900* has housing and operating components that are identical to those of the latch assembly 900 and the striker assembly 1000 that are depicted in FIGS. 15–18. A feature of the present invention resides in a determination that has been made that the U-shaped double-wedge-carrying striker assembly 1000 can, for use in certain installations, be simplified to take on an L-shaped configuration that carries a single wedge; and that the double-inclined-end configuration of the housing assembly 900 can, for use in certain installations, be simplified to provide only a single inclined end, as will be described.

Referring to FIGS. 19–22, the striker pin 14* is substantially identical to the striker pin 14, and has a cylindrical receiving portion 1002* that extends between an enlarged end region 1004* and an enlarged mounting flange 1006*. An elongate L-shape bracket 1010* is positioned adjacent the mounting flange 1006*. The L-shaped bracket 1010* has a central region 1011* that mounts the striker pin 14* and an end region 1012*. A wedge block 1022* is mounted on the end region 1012*, so that an inclined wedge surface 1032* is provided that faces inwardly in the vicinity of one side of the bracket 1010* to receive and engage the tapered surface 912* of the latch bracket side plate 626* when the latch 900* is moved into latching engagement with the striker assembly 1000*.

Figure 19:
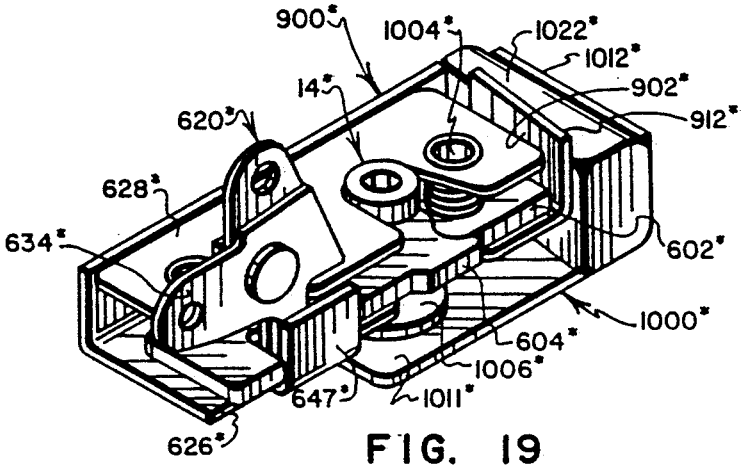
FIG. 19 is a perspective view, on an enlarged scale, showing a rotary latch and striker that employ a latch housing and a mating striker assembly that interengage in a wedge-like action in accordance with features of the present invention, with the view showing principally one side of each of the latch and the striker, and with the view showing the latch and striker in mating engagement.
Figure 21:
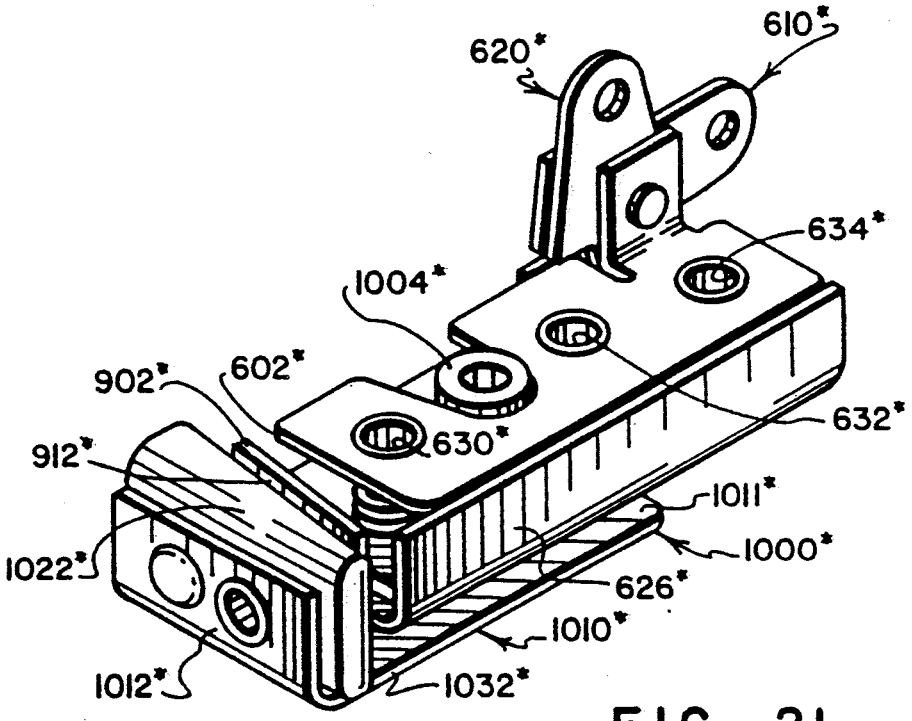
FIG. 21 is a perspective view similar to FIG. 19 but showing principally opposite sides of the latch and striker; and, FIG. 22 is a top plan view, on a slightly reduced scale, of the components of FIG. 21.
Figure 22:
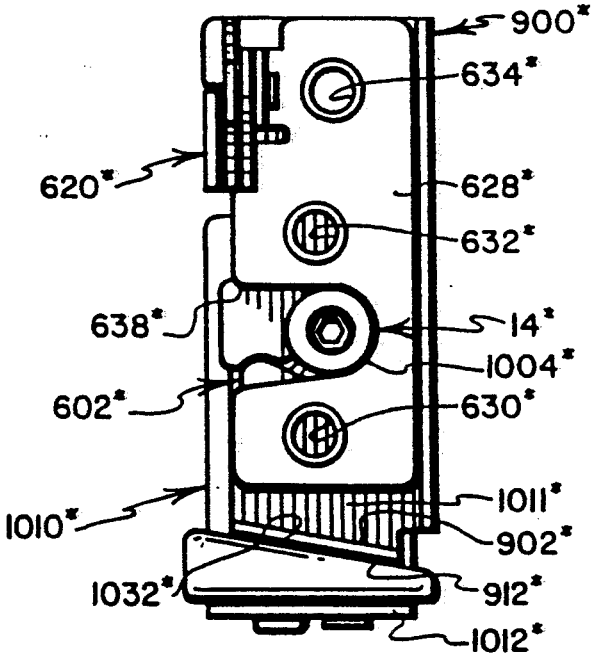

Latched engagement of the latch assembly 900* with the striker assembly 1000* is depicted in FIGS. 19 and 21–22. In FIG. 20 the assemblies **900*, 1000* are shown disengaged, with components of the latch assembly 900* "unlatched" in the manner that has been described in conjunction with the foregoing discussion of the latch 600**.

The wedge block 1022* preferably is formed from a rigid, high density plastics material such as nylon, with holes formed therethrough to accommodate rivets or other conventional fasteners that may be used to secure the wedge block 1022* to the end region 1012*. The angle of inclination of the wedge surface 1032* relative to the end region 1012* preferably is about 10 to 12 degrees. So that no unintended "wedging" action takes place that causes the latch housing plate 626* to become lodged or otherwise jammed into engagement with the wedge block 1022*, the angle of inclination of the inclined end surface 912* is selected to correspond to the angle of inclination of the wedge surface 1032*.

By the arrangement described above, a latch assembly 900* is provided that is (to an extent that is adequate for certain installations) received by striker assembly 1000* that serves to guide the latch assembly 900* into proper aligned relationship with the striker assembly 1000* during "latching" movements, and that serves to rigidly and securely maintain aligned engagement of the latch assembly 900* with the striker assembly 1000* when "latched." The type of secure latching engagement that is established, with the latch bolts **602*, 604* extending closely about the cylindrical receiving portion 1002* of the striker pin 14*** resists relative movements between door and door frame structures on which the latch and striker assemblies are mounted.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A rotary latch assembly, comprising a) striker means including a L-shaped bracket having an elongate central portion that interconnects with an end formation, and that has a generally cylindrical stud that is connected to the central portion and extends in cantilevered fashion at a spaced distance from the end formation;

b) rotary latch means including elongate latch housing means for defining a protective enclosure for latch operating components, and having means for defining an end region;

c) rotary latch bolt means including a pair of pivotal latch bolts mounted by the latch housing means for rotation in unison between latched and unlatched positions, and being operative, when in their latched positions, to securely grasp the stud that is carried by the L-shaped bracket of the striker means to releasably retain the rotary latch means in engagement with the striker means;

d) wedge block means including a wedge block member rigidly secured to the end formation of the L-shaped bracket of the striker means for defining an inclined surface that faces toward said stud;

e) inclined surface means defined by the end region of the latch housing means for engaging the inclined surface of the wedge block means when the rotary latch means is brought into latching engagement with the striker means to guide the rotary latch means into proper alignment with the striker means during latching and to retain the rotary latch means in proper alignment with the striker means while latched.

2. The rotary latch assembly of claim 1 wherein the wedge block is formed from rigid plastics material.

3. The rotary latch assembly of claim 2 wherein the wedge block is formed from nylon.

4. In a vehicle door lock system for a vehicle door that closes an access opening of a vehicle body, for securely latching the door in a closed position, and for locking the closed latched door, wherein the system is of the type including:

a) striker means for attachment to a vehicle body at a striker location near an access opening of the vehicle body that is closable by a door of the vehicle;

b) rotary latch means for attachment to the vehicle door at a latch location for rendering the door "latched" as by latchingly engaging the striker means for securely latching the vehicle door in a closed position, with the latch location being substantially adjacent the striker location when the vehicle door is closed;

c) latch operator means for attachment to the vehicle door for movement relative to the door between a normal position and a latch operating position, including first operator means connected to the vehicle door at a first operator location which is spaced from the latch location, with the first operator means being movable at the first operator location between a first normal position and a first latch operating position;

d) connection means for establishing a driving connection between the latch operator means and the rotary latch means to normally enable the latch operator means to "unlatch" the door as by releasing the rotary latch means from latchingly engaging the striker means and to thereby enable the vehicle door to be moved from its closed position, including first linkage means that extends along a first path from the first operator location to the latch location, and with the first linkage means being drivingly connected to the first operator means at the first operator location and to the rotary latch means at the latch location for normally establishing a driving connection that extends along the first path for enabling the first operator means to unlatch the door as by causing the rotary latch means to withdraw latching engagement of the rotary latch means with the striker means and to thereby unlatch the door in response to movement of the first operator means between the first normal position and the first latch operator position;

e) lock control means for selectively disabling the normal driving connection that is provided by the connection means between the latch operator means and the rotary latch means when the door is latched and to thereby "lock" the closed latched door against being unlatched, including first control means for selectively preventing the first linkage means from enabling the first operator means to unlatch the rotary latch means from latching engagement with the striker means;

f) the first linkage means including at least a first pair of elongate linkage elements, with one of the linkage elements of the first pair of linkage elements being connected to the first operator means, and with the other of the linkage elements of the first pair of linkage elements being connected to the rotary latch means;

g) the first control means including first paired lever means for normally drivingly connecting the linkage elements of the first pair of linkage elements, but also for selectively disrupting the normal driving connection between the linkage elements of the first pair of linkage elements to thereby selectively prevent the first linkage means from enabling the first operator means to unlatch the rotary latch means from latching engagement with the striker means, the first paired lever means having a first pair of pivotally mounted levers that are connected to the door for pivotal movement about a common axis of pivotal movement, with the levers of the first pair of pivotally mounted levers extending in overlying relationship, and with one of the levers of the first pair of pivotally mounted levers being connected to a first of the linkage elements of the first pair of linkage elements, and with the other of the levers of the first pair of pivotally mounted levers being connected to a second of the linkage elements of the first pair of linkage elements, and with the first control means additionally including first connection means coupled to both of the linkage elements of the first pair of linkage elements for movement between a connection position wherein the first connection means is operable to drivingly connect the linkage elements of the first pair of linkage elements for concurrent pivotal movement about said common axis so that movement of either one of the linkage elements of the first pair of linkage elements will result in corresponding movement of the other of the linkage elements of the first pair of linkage elements, and a disconnection position wherein the first connection means is operable to drivingly disconnect the linkage elements of the first pair of linkage elements for concurrent pivotal movement about said common axis so that movement of either one of the linkage elements of the first pair of linkage elements will not result in corresponding movement of the other of the linkage elements of the first pair of linkage elements, and positioning means for effecting movement of the first connection means between its connection position and its disconnection position; and, h) the position means including at least one control lever that is pivotally connected to the door and that extends in overlying relationship with at least one of the levers of the first pair of pivotally mounted levers, a first control member located at a first control location spaced from the location of the control lever, and elongate control linkage means for drivingly connecting the first control member to the control lever, with the control lever being operable, in response to movement of the first control member, to effect movement of the first connection means between its connection position and its disconnection position;

i) the improvement, wherein:

a) the striker means includes an L-shaped bracket having an elongate central portion that interconnects with an end formation, and that has a generally cylindrical stud that is connected to the central portion and extends in cantilevered fashion from the central formation at a location spaced from the end formation;

b) the rotary latch means includes elongate latch housing means for defining a protective enclosure for latch operating components, and having means for defining an end region;

c) the rotary latch means further includes rotary latch bolt means including a pair of pivotal latch bolts mounted by the latch housing means for rotation in unison between latched and unlatched positions, and being operative, when in their latched positions, to securely grasp the stud that is carried by the L-shaped bracket of the striker means to releasably retain the rotary latch means in engagement with the striker means;

d) the striker further includes wedge block means including a wedge block member rigidly secured to the end formation of the L-shaped bracket of the striker means for defining an inclined surface that faces toward said stud; and, e) the rotary latch means further includes inclined surface means defined by the end region of the latch housing means for engaging the opposed inclined surface of the wedge block means when the rotary latch means is brought into latching engagement with the striker means to guide the rotary latch means into proper alignment with the striker means during latching and to retain the rotary latch means in proper alignment with the striker means while latched.

5. The door lock system of claim 4 wherein the wedge block is formed from rigid plastics material.

6. The door lock system of claim 5 wherein the wedge block is formed from nylon.

7. The door lock system of claim 4 wherein the first control member is a key operated lock that is operable from an exterior side of the vehicle door.

8. The door lock system of claim 4 wherein the first control member is a sill button that is movable between locked and unlocked positions from an interior side of the vehicle door.

9. The door lock system of claim 4 wherein the positioning means additionally includes a second control member located at a second control location spaced from the location of the control lever, and second elongate control linkage means for drivingly connecting the second control member to the control lever, with the control lever being operable, in response to movement of either of the first and second control members to effect movement of the first connection means between its connection position and its disconnection position.

10. The door lock system of claim 9 wherein the first control member is a key operated lock that is operable from an exterior side of the vehicle door.

11. The door lock system of claim 10 wherein the second control member is a sill button that is movable between locked and unlocked positions from an interior side of the vehicle door.

12. The door lock system of claim 4 wherein the first control means includes non-identically configured but alignable slot formations formed in the levers of the first pair of pivotally mounted levels, the first connection means includes connection pin means extending through the slot formations, and the control lever is operable to move the connection pin means relative to the slot formations between said connection position wherein the connection pin means serves to establish a driving connection that assures concurrent pivotal movement of the levers of the first pair of pivotally mounted levers about the common axis, and said disconnection position wherein the connection pin means provides no such driving connection between the levers of the first pair of pivotally mounted levers.

13. The door lock system of claim 4 wherein the first control means includes bracket means for mounting in close proximity to the latch location, with the first pair of pivotally mounted levers and the control lever being pivotally connected to the bracket means for pivotal movement about said common axis.

14. The door lock system of claim 4 wherein the first latch operator means includes an internal door handle operating assembly that is operable from an internal side of the door to unlatch the door.

15. The door lock system of claim 4 wherein the latch operator means includes separate interior and exterior handle means connected to separate interior and exterior portions of the vehicle door, with each of the separate interior and exterior handle means having a separate actuator member that is movable relative to the door, with one of the separate actuator members comprising said first operator means, and with operating linkage means being provided for connecting the other of the separate actuator members to the rotary latch means for unlatching the rotary latch means in response to movement of said other of the separate actuator members.

16. The door lock system of claim 15 wherein said one of the actuator members that comprises said first operator means is the actuator member of the interior handle means.

17. The door lock system of claim 4 wherein the rotary latch means includes:

a) housing means including structure defining a notch into which the body portion of the striker means is admitted as the door is closed;

b) first and second bolt members pivotally supported by the housing means at spaced locations on opposite sides of the notch for movement between latching and unlatching positions;

c) each of the bolt members being provided with:

i) a recess formation facing generally toward the notch for receiving and engaging the body portion of the striker means when the body portion is admitted to the notch; and, ii) a cam surface which cooperates with the cam surface on the other of the bolt members for assisting to effect concurrent movement of the bolt members between their latching and unlatching positions;

d) the recess formations being configured such that, when the bolt members are in their unlatching positions, the striker means may be moved into and out of the notch, and such that when the striker means is received in the recess formations with the bolt members in their latching positions, the striker means is retained in the notch by the bolt members;

e) first biasing means biasing the bolt members toward their unlatching positions;

f) one of the bolt members having at least one abutment formation thereon;

g) a pawl movably carried on the housing means and having tooth means which is engageable with the abutment formation for preventing unlatching movement of the bolt members;

h) second biasing means for biasing the tooth means into engagement with the abutment formation when the bolt members are moved to their latching positions; and, i) operating means for moving the pawl in opposition to the second biasing means to release the tooth means from engagement with the abutment formation to permit the bolt members to move under the influence of the first biasing means toward their unlatching positions to release the striker means; and, j) the bolt members being provided with stop formations configured to engage each other when the bolt members are in their latching positions to prevent further rotation of the bolt members in directions away from their unlatching positions, and to thereby positively prevent the bolt members from becoming inoperably jammed together.

18. The latch-type fastener means of claim 17 wherein the recess formations are configured to close toward the striker means as the striker means is moved into the notch and as the bolt members move concurrently toward their latching positions.

19. The latch-type fastener means of claim 18 wherein the recess formations are configured such that, as they close toward each other, they serve to center the striker means with respect to opposite sides of the notch, whereby, when the bolt members are in their latching positions, they hold the striker means at a predetermined centered location out of engagement with such portions of the housing structure as define the notch.

20. The latch-type fastener mechanism of claim 18 wherein the housing means is formed as an assembly including a pair of side plates, three parallel-oriented bushings positioned at spaced locations between the side plates.

21. The latch-type fastener mechanism of claim 20 wherein each of the bolt members is journaled on a separate one of the bushings, and the pawl is journaled on the remaining one of the bushings.

22. In a door lock system for a vehicle door that closes an access opening of a vehicle body, for securely latching the door in a closed position, and for locking the closed latched door, wherein the system is of the type including:

a) striker means including a plurality of striker members for attachment to a vehicle body at a plurality of spaced striker locations near an access opening of the vehicle body that is closable by a door of the vehicle;

b) rotary latch means including a plurality of rotary latch units for attachment to the vehicle door at plurality of spaced latch locations for rendering the door "latched" as by latchingly engaging the striker means for securely latching the vehicle door in a closed position, with the latch locations each being adjacent a separate one of the striker locations when the vehicle door is closed, and with each of the rotary latch units latchingly engaging a separate one of the striker members when the door is closed;

c) latch operator means for attachment to the vehicle door, including:

i) first operator means connected to the vehicle door at a first operator location which is spaced from each of the latch locations, with the first operator means being movable at the first operator location between a first normal position and a first latch operating position; and, ii) second operator means connected to the vehicle door at a second operator location which is spaced from each of the latch locations, with the second operator means being movable at the second operator location between a second normal position and a second latch operating position;

d) latch unit interconnection means for drivingly interconnecting the rotary latch units to effect concurrent unlatching of the rotary latch units from latching engagement with their associated striker members;

e) connection means for establishing a driving connection between the latch operator means and a selected one of the rotary latch units to normally enable the latch operator means to "unlatch" the door as by releasing the selected rotary latch unit from latchingly engaging its associated striker member and, through concurrent operation of the latch unit interconnection means, to release the other of the rotary latch units from latching engagement with their associated striker members to thereby enable the vehicle door to be moved from its closed position, the connection means including:

i) first linkage means that extends along a first path from the first operator location to the latch location of the selected rotary latch unit, and with the first linkage means being drivingly connected to the first operator means at the first operator location and to the selected rotary latch unit at its latch location for normally establishing a driving connection that extends along the first path for enabling the first operator means to unlatch the door as by causing the rotary latch means to withdraw latching engagement of the rotary latch means with the striker means and to thereby unlatch the door in response to movement of the first operator means between the first normal position and the first latch operator position; and, ii) second linkage means that extends along a second path from the second operator location to the latch location of the selected rotary latch unit, and with the second linkage means being drivingly connected to the second operator means at the second operator location and to the selected rotary latch unit at its latch location for normally establishing a driving connection that extends along the second path for enabling the second operator means to unlatch the door as by causing the rotary latch means to withdraw latching engagement of the rotary latch means with the striker means and to thereby unlatch the door in response to movement of the second operator means between the second normal position and the second latch operator position; and, f) lock control means for selectively disabling the normal driving connection that is provided by the connection means between the first operator means and the selected rotary latch unit means when the door is latched and to thereby "lock" the closed latched door against being unlatched, including first control means for selectively preventing the first linkage means from enabling the first operator means to unlatch the rotary latch means from latching engagement with the striker means;

i) the improvement, wherein:

a) the striker means includes an L-shaped bracket having an elongate central portion that interconnects with an end formation, and that has a generally cylindrical stud that is connected to the central portion and extends in cantilevered fashion from the central portion at a location spaced from the end formation;

b) the rotary latch means includes elongate latch housing means for defining a protective enclosure for latch operating components, and having means for defining an end region;

c) the rotary latch means further includes rotary latch bolt means including a pair of pivotal latch bolts mounted by the latch housing means for rotation in unison between latched and unlatched positions, and being operative, when in their latched positions, to securely grasp the stud that is carried by the L-shaped bracket of the striker means to releasably retain the rotary latch means in engagement with the striker means;

d) the striker means further includes wedge block means including a wedge block member rigidly secured to the end formation of the L-shaped bracket of the striker means for defining an inclined surface that faces toward said stud; and, e) the rotary latch means further includes inclined surface means defined by the end region of the latch housing means for engaging the opposed inclined surface of the wedge block means when the rotary latch means is brought into latching engagement with the striker means to guide the rotary latch means into proper alignment with the striker means during latching and to retain the rotary latch means in proper alignment with the striker means while latched.

23. The door lock system of claim 22 wherein the wedge block is formed from rigid plastics material.

24. The door lock system of claim 23 wherein the wedge block is formed from nylon.

25. The door lock system of claim 22 wherein the first control member is a key operated lock that is operable from an exterior side of the vehicle door.

26. The door lock system of claim 25 wherein the first latch operator means includes an external door handle operating assembly that is operable from an external side of the door to unlatch the door, and the second latch operator means includes an internal door handle operating assembly that is operable from an internal side of the door to unlatch the door.

27. The door lock system of claim 22 wherein the first control member is a sill button that is movable between locked and unlocked positions from an interior side of the vehicle door.

28. The door lock system of claim 22 wherein:

a) the first linkage means includes a first release lever pivotally connected to the selected rotary latch unit for pivotal movement about a common axis between a first non-actuated position and a first release position for effecting unlatching of the selected rotary latch unit when the first release lever is pivoted to the first release position;

b) the second linkage means includes a second release lever pivotally connected to the selected rotary latch unit for pivotal movement about said common axis between a second non-actuated position and a second release position for effecting unlatching of the selected rotary latch unit when the second release lever is pivoted to the second release position;

c) the rotary latch units other than the selected rotary latch unit each have a pawl that is pivotally movable to an unlatching position for effecting unlatching;

d) the latch unit interconnection means includes drive link means including separate drive links drivingly connected to the pawls of each of said other rotary latch units for pivoting the pawls thereof to their unlatching positions in response to unlatching of their associated separate drive links; and, e) the latch unit interconnection means additionally includes an operating arm that is pivotally connected to the selected rotary latch means and to the drive link means for moving the drive link means to unlatch the other rotary latch means in response to pivotal movement of either of the first and second release lever means into releasing engagement with the release means of the selected rotary latch.

29. The door lock system of claim 28 wherein the operating arm is pivotally connected to the selected rotary latch means for pivoting about said common axis, and the operating arm carries separate formation means for extending into paths of movement followed by the first and second release levers, respectively, in moving between their non-actuated positions and their release positions to effect unlatching movement of the operating arm about the common axis in response to unlatching movement of either of the first and second release levers about the common axis.

30. The door lock system of claim 22 wherein each of the rotary latch units includes:

a) housing means including structure defining a notch into which the body portion of the striker means is admitted as the door is closed;

b) first and second bolt members pivotally supported by the housing means at spaced locations on opposite sides of the notch for movement between latching and unlatching positions;

c) each of the bolt members being provided with:

i) a recess formation facing generally toward the notch for receiving and engaging the body portion of the striker means when the body portion is admitted to the notch; and, ii) a cam surface which cooperates with the cam surface on the other of the bolt members for assisting to effect concurrent movement of the bolt members between their latching and unlatching positions;

d) the recess formations being configured such that, when the bolt members are in their unlatching positions, the striker means may be moved into and out of the notch, and such that when the striker means is received in the recess formations with the bolt members in their latching positions, the striker means is retained in the notch by the bolt members;

e) first biasing means biasing the bolt members toward their unlatching positions;

f) one of the bolt members having at least one abutment formation thereon;

g) a pawl movably carried on the housing means and having tooth means which is engageable with the abutment formation for preventing unlatching movement of the bolt members;

h) second biasing means for biasing the tooth means into engagement with the abutment formation when the bolt members are moved to their latching positions;

i) operating means for moving the pawl in opposition to the second biasing means to release the tooth means from engagement with the abutment formation to permit the bolt members to move under the influence of the first biasing means toward their unlatching positions to release the striker means; and, j) the bolt members being provided with stop formations configured to engage each other when the bolt members are in their latching positions to prevent further rotation of the bolt members in directions away from their unlatching positions, and to thereby positively prevent the bolt members from becoming inoperably jammed together.

31. The door lock system of claim 30 wherein the recess formations are configured to close toward the striker means as the striker means is moved into the notch and as the bolt members move concurrently toward their latching positions.

32. The door lock system of claim 31 wherein the recess formations are configured such that, as they close toward each other, they serve to center the striker means with respect to opposite sides of the notch, whereby, when the bolt members are in their latching positions, they hold the striker means at a predetermined centered location out of engagement with such portions of the housing structure as define the notch.

33. The door lock system of claim 31 wherein the housing means is formed as an assembly including a pair of side plates and three parallel-oriented bushings positioned at spaced locations between the side plates.

34. The door lock system of claim 33 wherein each of the bolt members is journaled on a separate one of the bushings, and the pawl is journaled on the remaining one of the bushings.

35. In a door lock system for a vehicle door that closes an access opening of the vehicle body, for securely latching the door in a closed position, and for locking the closed latched door, wherein the system includes a plurality of rotary latches mounted on a vehicle door for engaging a plurality of strikers mounted on the vehicle body, with both exterior and interior handle assemblies being mounted on the door and being operable to unlatch the door except that, when the system is locked, at least the exterior handle assembly is disabled and wherein the system is of the type comprising:

a) striker means including a plurality of striker members mounted on a vehicle body at spaced striker locations which are adjacent a body access opening that provides access from an exterior of the body to an interior of the body, with the access opening being selectively closable by a vehicle door;

b) rotary latch means including a plurality of rotary latch units mounted on a vehicle door that is movable between open and closed positions to selectively close the body access opening, with the rotary latch means being operable to render the door "latched" as by causing the rotary latch units to each latchingly engage a separate one of the striker members when the door is in its closed position to securely latch the door, with the rotary latch units being mounted on the vehicle door at spaced latch locations that are adjacent the striker locations when the vehicle door is closed, and with the vehicle door having an interior and an exterior;

c) latch operator means mounted on the vehicle door including interior handle means which is accessible from and operable from an interior side of the door and from an interior portion of the vehicle body, and exterior handle means which is accessible from and operable from an exterior side of the door and from the exterior of the body;

d) the latch operator means additionally including first operator means carried by the vehicle door at a first operator location which is spaced from each of the latch locations and being drivingly connected to a selected one of the interior handle means and the exterior handle means, with the first operator means being movable at the first operator location between a first normal position and a first latch operating position;

e) the latch operator means additionally including second operator means carried by the vehicle door and being drivingly connected to the other of the interior handle means and the exterior handle means;

f) latch unit interconnection means for rotary latch units to effect concurrent unlatching of the rotary latch units from latching engagement with their associated striker members;

g) connection means for establishing a driving connection between the first operator means and a selected one of the rotary latch units, and between the second operator means and the selected one of the rotary latch units, to normally enable the interior handle means and the exterior handle means of the latch operator means to "unlatch" the door as by releasing the rotary latch means from latchingly engaging the striker means and to thereby enable the vehicle door to be moved from its closed position, and being operable to disable at least one of the interior handle means and the exterior handle means of the latch operator means from "unlatching" the door;

h) the connection means including first linkage means that extends along a first path from the first operator location to the latch location of the selected rotary latch unit, and with the first linkage means being drivingly connected to the first operator means at the first operator location and to the selected rotary latch means at its latch location for normally establishing a driving connection that extends along the first path for enabling the first operator means to unlatch the door as by causing the rotary latch means to withdraw latching engagement of the rotary latch means with the striker means and to thereby unlatch the door in response to movement of the first operator means between the first normal position and the first latch operator position;

i) lock control means for selectively disabling the normal driving connection that is provided by the connection means between the latch operator means and the rotary latch means when the door is latched and to thereby "lock" the closed latched door against being unlatched, including first control means for selectively preventing the first linkage means from enabling the first operator means to unlatch the rotary latch means from latching engagement with the striker means;

j) the first linkage means including at least a first pair of elongate linkage elements, with one of the linkage elements of the first pair of linkage elements being connected to the first operator means, and with the other of the linkage elements of the first pair of linkage elements being connected to the rotary latch means;

k) the first control means including first paired lever means for normally drivingly connecting the linkage elements of the first pair of linkage elements, but also for selectively disrupting the normal driving connection between the linkage elements of the first pair of linkage elements to thereby selectively prevent the first linkage means from enabling the first operator means to unlatch the rotary latch means from latching engagement with the striker means, the first paired lever means having a first pair of pivotally mounted levers that are connected to the door for pivotal movement about a common axis of pivotal movement, with the levers of the first pair of pivotally mounted levers extending in overlying relationship, and with one of the levers of the first pair of pivotally mounted levers being connected to a first of the linkage elements of the first pair of linkage elements, and with the other of the levers of the first pair of pivotally mounted levers being connected to a second of the linkage elements of the first pair of linkage elements, and with the first control means additionally including first connection means coupled to both of the linkage elements of the first pair of linkage elements for movement between a connection position wherein the first connection means is operable to drivingly connect the linkage elements of the first pair of linkage elements for concurrent pivotal movement about said common axis so that movement of either one of the linkage elements of the first pair of linkage elements will result in corresponding movement of the other of the linkage elements of the first pair of linkage elements, and a disconnection position wherein the first connection means is operable to drivingly disconnect the linkage elements of the first pair of linkage elements for concurrent pivotal movement about said common axis so that movement of either one of the linkage elements will not result in corresponding movement of the other of the linkage elements of the first pair of linkage elements, and positioning means for effecting movement of the first connection means between its connection position and its disconnection position;

l) the positioning means including:

i) at least one control lever that is pivotally connected to the door and that extends in overlying relationship with at least one of the levers of the first pair of pivotally mounted levers;

ii) a first control member located at a first control location spaced from the location of the control lever, and first elongate control linkage means for drivingly connecting the first control member to the control lever, with the control lever being operable, in response to movement of the first control member, to effect movement of the first connection means between its connection position and its disconnection position; and, iii) a second control member located at a second control location spaced from the location of the control lever, and second elongate control linkage means for drivingly connecting the second control member to the control lever, with the control lever being operable, in response to movement of the second control member, to effect movement of the first connection means between its connection position and its disconnection position;

m) the first control member including a key operated lock that is mounted on the vehicle door and that is operable from the exterior of the door; and, n) the second control member including interior lock operator means mounted on the vehicle door and being accessible from the interior side of the door;

o) the improvement, wherein:

i) the striker means includes an L-shaped bracket having an elongate central portion that interconnects with an end formation, and that has a generally cylindrical stud that is connected to the central portion and extends in cantilevered fashion at a location spaced from the end formation;

ii) the rotary latch means includes elongate latch housing means for defining a protective enclosure for latch operating components, and having means for defining an end region;

iii) the rotary latch means further includes rotary latch bolt means including a pair of pivotal latch bolts mounted by the latch housing means for rotation in unison between latched and unlatched positions, and being operative, when in their latched positions, to securely grasp the stud that is carried by the L-shaped bracket of the striker means to releasably retain the rotary latch means in engagement with the striker means;

iv) the striker means further includes wedge block means including a wedge block member rigidly secured to the end formation of the L-shaped bracket of the striker means for defining an inclined surface that faces toward said stud; and, v) the rotary latch means further includes inclined surface means defined by the end region of the latch housing means for engaging the opposed inclined surface of the wedge block means when the rotary latch means is brought into latching engagement with the striker means to guide the rotary latch means into proper alignment with the striker means during latching and to retain the rotary latch means in proper alignment with the striker means while latched.

36. The door lock system of claim 35 wherein the wedge block is formed from rigid plastics material.

37. The door lock system of claim 36 wherein the wedge block is formed from nylon.

38. The door lock system of claim 35 wherein the interior lock operator means includes a sill button that is movable between locked and unlocked positions, and that is accessible from the interior side of the door for locking and unlocking the rotary latch.

39. The door lock system of claim 38 wherein the first linkage means is operable to connect the rotary latch means with the interior and exterior handle means, the key operated lock and the sill button such that, 1) when the door is "latched" but not "locked," either of the interior and exterior handle means may be operated to unlatch the door, 2) when the door is both "latched" and "locked," neither of the interior and exterior handle means may be operated to unlatch the door, and, 3) such locking and unlocking movements as are executed by the key operated lock will cause corresponding movements of the sill button between its locked and unlocked positions, whereby the positioning of the sill button is indicative of the "locked" and "unlocked" status of the door lock system.

40. The door lock system of claim 38 wherein the striker means includes a striker pin, and the rotary latch means includes a housing having a notch for reception of the striker pin when the vehicle door is closed, a pair of bolt members each having a recess formed therein for receiving the striker pin when the vehicle door is closed, means pivotally connecting the bolt members to the housing on opposite sides of the notch for movement between a first position wherein the bolt recesses are aligned with the notch to permit the striker pin to be moved into and out of the notch, and a second position wherein the bolt members extend into the notch from opposite sides thereof to retain the striker pin therein, a spring-biased pawl pivotally carried by the housing for engaging one of the bolt members to releasably retain both of the bolt members in the second position, operator means connected to the frame for releasing the pawl from retaining engagement with the one bolt member, means for pivoting the bolt members in unison between their latching and unlatching positions, and the bolt members being provided with stop formations configured to engage each other when the bolt members are in their latching positions to prevent further rotation of the bolt members in directions away from their unlatching positions, and to thereby positively prevent the bolt members from becoming inoperably jammed together.

41. A rotary lock system for a door that closes an access opening, for securely latching the door in a closed position, and for locking the closed latched door, the system comprising:

a) striker means including a plurality of strikers members for attachment to structure that surrounds and defines the access opening that is closable by the door;

b) rotary latch means including a plurality of rotary latch units for attachment to the door at a plurality of spaced latch locations for rendering the door "latched" as by latchingly engaging the striker means for securely latching the vehicle door in a closed position, with the latch locations each being adjacent a separate one of the striker locations when the door is closed;

c) each of the striker members including an L-shaped bracket having an elongate central portion that interconnects with an end formation, and that has a generally cylindrical stud that is connected to the central portion and extends in cantilevered fashion therefrom at a location spaced from the end formation;

d) each of the rotary latch units including elongate latch housing means for defining a protective enclosure for latch operating components, and for defining an end region;

e) each of the rotary latch units further including rotary latch bolt means including a pair of pivotal latch bolts mounted by the latch housing means for rotation in unison between latched and unlatched positions, to securely grasp the stud of an associated one of the striker members to releasably retain the rotary latch unit in engagement with said associated one of the striker members;

f) each of the striker members further including wedge block means including a wedge block member rigidly secured to the end formation of the L-shaped bracket of the striker member for defining an inclined surface that faces toward the stud of the striker member;

g) each of the rotary latch units further including inclined surface means defined by an end region of the latch housing means of the latch unit for engaging the inclined surface of the wedge block means of an associated one of the striker members when the rotary latch unit is brought into latching engagement with said associate one of the striker members to guide the rotary latch unit into proper alignment with the striker member during latching and to retain the rotary latch unit in proper alignment with the striker member while latched.

42. The rotary latch assembly of claim 41 wherein the wedge blocks are formed from rigid plastics material.

43. The rotary latch assembly of claim 42 wherein the wedge blocks are formed from nylon.

* * * * *